US005412413A

United States Patent [19]

Sekiya et al.

[11] Patent Number: 5,412,413

[45] Date of Patent: May 2, 1995

[54] METHOD AND APPARATUS FOR MAKING LIQUID DROP FLY TO FORM IMAGE BY GENERATING BUBBLE IN LIQUID

[75] Inventors: Takuro Sekiya; Takashi Kimura; Masanori Horike, all of Yokohama; Yoshio Watanabe, Kawasaki; Shuji Motomura, Yokohama; Eiko Suzuki, Sagamihara; Takayuki Yamaguchi, Mino; Masami Kadonaga, Yokohama, all of Japan

[73] Assignee: Ricoh Co., Ltd., Tokyo, Japan

[21] Appl. No.: 971,668

[22] Filed: Nov. 4, 1992

Related U.S. Application Data

[63] Continuation of Ser. No. 630,321, Dec. 19, 1990, abandoned.

[30] Foreign Application Priority Data

| | | | |
|---|---|---|---|
| Dec. 22, 1989 | [JP] | Japan | 1-334232 |
| May 10, 1990 | [JP] | Japan | 2-120586 |
| Aug. 30, 1990 | [JP] | Japan | 2-229140 |

[51] Int. Cl.[6] ..... B41J 2/05

[52] U.S. Cl. ..... 347/46; 347/61; 347/65

[58] Field of Search ..... 346/140, 1.1; 347/46, 347/61, 65

[56] References Cited

U.S. PATENT DOCUMENTS

| | | | |
|---|---|---|---|
| 4,345,262 | 8/1982 | Shirato | 346/140 |
| 4,410,899 | 10/1983 | Haruta | 346/140 R |
| 4,490,728 | 12/1984 | Vaught | 346/140 X |
| 4,502,060 | 2/1985 | Rankin | 346/140 |
| 4,558,333 | 12/1985 | Sugitani | 346/140 |
| 4,580,148 | 4/1986 | Domoto | 346/140 |
| 4,683,481 | 7/1987 | Johnson | 346/140 |
| 4,764,777 | 8/1988 | Saito | 346/140 R |
| 4,794,410 | 12/1988 | Taub | 346/140 |
| 4,882,595 | 11/1989 | Trueba | 346/140 |
| 4,897,674 | 1/1990 | Hirasawa | 346/140 |
| 4,980,703 | 12/1990 | Sakurai | 346/140 R |
| 4,990,939 | 2/1991 | Sekiya et al. | 346/140 |
| 5,021,808 | 6/1991 | Kohyama | 346/140 R |

FOREIGN PATENT DOCUMENTS

| | | | |
|---|---|---|---|
| 273664 | 7/1988 | European Pat. Off. . | |
| 132036 | 11/1976 | Japan . | |
| 0189949 | 8/1986 | Japan | B41J 3/04 |
| 0189950 | 8/1986 | Japan | B41J 3/04 |
| 59914 | 12/1986 | Japan . | |
| 0253456 | 11/1987 | Japan | B41J 3/04 |
| 182152 | 7/1988 | Japan | B41J 3/04 |
| 0030758 | 2/1989 | Japan | B41J 3/04 |
| 101157 | 4/1989 | Japan . | |

OTHER PUBLICATIONS

Lauterborn, W., et al., "Experimental investigations of cavitation-bubble collapse in the neighbourhood of a solid boundary," *Journal of Fluid Mechanics,* vol. 72, part 2, pp. 391-399, Great Britain, 1975.

*Primary Examiner*—Joseph W. Hartary
*Attorney, Agent, or Firm*—Cooper & Dunham

[57] ABSTRACT

A liquid jet recording head includes a base member, a liquid layer maintained on the base member and a plurality of heater elements, arranged in a line on the base member, for supplying energy to liquid adjacent thereto, the energy operation portions being put under the liquid layer. A method for making a liquid drop fly from the liquid jet recording head onto a recording sheet so that a dot image is formed on the recording sheet includes steps of (a) generating a bubble in the liquid to which the energy is supplied by each of energy operation portions in accordance with image data; (b) making the bubble grow up until a predetermined size of the bubble is obtained; (c) contracting the bubble under a condition where each of the energy portions supplies no energy to the liquid in which the bubble is formed; and (d) making the bubble disappear into the liquid.

12 Claims, 23 Drawing Sheets

METHOD AND APPARATUS FOR MAKING LIQUID DROP FLY TO FORM IMAGE BY GENERATING BUBBLE IN LIQUID

This is a continuation of application Ser. No. 07/630,321 filed Dec. 19, 1990, now abandoned.

BACKGROUND OF THE INVENTION

The present invention generally relates to a method and an apparatus for making a liquid drop fly to form an image by generating a bubble in a liquid, and more particularly to a method and an apparatus for making a liquid drop fly to form an image by generating a bubble in a liquid without using a nozzle.

Conventionally, a method and apparatus for making a liquid drop fly to form an image by generating a bubble in a liquid has been proposed in Japanese Patent Publication No. 61-59914. This method and apparatus is respectively often referred to as a liquid jet recording method and a liquid jet recording head. In the liquid jet recording method and the liquid jet recording head, a liquid, such as ink, provided in a flow path connected to a nozzle is heated and a film boiling is formed in the liquid. Then a bubble is generated by the boiling film in the liquid and a liquid drop is jetted from the nozzle by propulsion based on the rapid growth of the bubble. The liquid drop jetted from the nozzle flies to a recording sheet so that an image is formed on the recording sheet.

The conventional apparatus as described above comprises the nozzle from which the liquid drop is jetted. A diameter of an orifice formed on the nozzle is vary small, for example, 60 um. Thus, it is difficult to accurately form the nozzle. In addition, the nozzle can be clogged by dust which is generated in a system for supplying a liquid (ink), impurities in the liquid and so on. Then, when the nozzle is clogged by the dust and so on, the liquid drop can not fly regularly from the nozzle.

A conventional liquid jet recording head not using the nozzle is also proposed in Japanese Laid-Open Patent Application Nos. 51-132036 and 1-101157. In the liquid jet recording head disclosed in Japanese Laid-Open Patent Application No. 51-132036, a bubble is generated and grows in ink. When the grown bubble is exploded and the ink returns to the original condition, an ink drop is generated and flies. According to the conventional liquid jet recording head as described above, when the bubble is exploded, the ink is scattered like a mist. Thus, the quality of an image formed on the recording sheet is deteriorated by the scattered ink mist.

On the other hand, in the liquid jet recording head disclosed in Japanese Laid-Open Patent Application No. 1-101157, a small heater element provided in ink is rapidly heated so that the ink is rapidly boiled and the ink mist is generated. Then the ink mist flies to the recording sheet and an image is formed on the recording sheet. According to the conventional liquid jet recording head as described above, the image is formed by the ink mist on the recording sheet so that it is difficult to form a clear image on the recording sheet.

SUMMARY OF THE INVENTION

Accordingly, a general object of the present invention is to provide a novel and useful method and apparatus for making ink fly to form an image in which the disadvantages of the aforementioned prior art are eliminated.

A more specific object of the present invention is to provide a method for making ink fly to form an image by generating a bubble in ink in which there is no disadvantage in that the nozzle is clogged by dust, impurities and so on.

Another object of the present invention is to provide a method for making ink fly to form an image by generating a bubble in ink by which it is possible to form a clear image on the recording sheet.

The above objects of the present invention are achieved by a method for making a liquid drop fly from an liquid jet recording head onto a recording sheet so that a dot image is formed on the recording sheet, the liquid jet recording head having a base member, a liquid layer maintained on the base member and a plurality of energy operation portions, arranged in a line on the base member, for supplying energy to liquid adjacent thereto, the energy operation portions being put under the liquid layer, the method comprising the steps of, (a) generating a bubble in the liquid to which the energy is supplied by each of energy operation portions in accordance with image data; (b) making the bubble grow up until a predetermined size of the bubble is obtained; (c) contracting the bubble under a condition where each of the energy portions supplies no energy to the liquid in which the bubble is formed; and (d) making the bubble disappear into the liquid, wherein a liquid column projects from the surface of the liquid layer, the liquid column is separated from the surface of the liquid layer and then a liquid drop flies from the liquid layer, due to a pressure in the liquid which is generated by the bubble.

Another object of the present invention is to provide a liquid jet recording head in which there is no disadvantage in that the nozzle is clogged by the dust, the impurities and so on.

More specific object of the present invention is to provide a liquid jet recording head in which it is possible to form a clear image on the recording sheet.

The above objects of the present invention are achieved by a liquid jet recording head for making a liquid drop fly onto a recording sheet so that a dot image is formed on the recording sheet, the liquid jet recording head comprising, a base member; a liquid layer maintained on the base member; a plurality of energy operation portions, arranged in a line on the base member, for supplying energy to liquid adjacent thereto, the energy operation portions being put under the liquid layer, a bubble being generated in the liquid when each of the energy operation portions supplies the energy to the liquid adjacent thereto; and a plurality of walls, provided on the base member so as to surround the bubble generated in the liquid when each energy operation portion supplies the energy to the liquid, for preventing a pressure in the liquid which is generated by the growth of the bubble from dispersing in a direction parallel to the surface of the liquid layer, wherein a ratio $h_1/h_2$ of an original depth $h_1$ of the liquid layer and the height $h_2$ of the bubble having the largest size is equal to or greater than 0.8.

The above objects of the present invention are also achieved by a liquid jet recording head for making a liquid drop fly onto a recording sheet so that a dot image is formed on the recording sheet, the liquid jet recording head comprising, a base member; liquid storage means, provided on the base member, for storing liquid; a plurality of energy operation portions, arranged in a line on the base member, for supplying energy to liquid adjacent thereto, the energy operation portions being put under the liquid stored in the liquid storage means, a bubble being generated in the liquid when each of the energy operation portions supplies the energy to the liquid adjacent thereto; a plurality of walls, provided on the base member so as to surround the bubble generated in the liquid when each energy operation portion supplies the energy to the liquid, for preventing a pressure in the liquid which is generated by the growth of the bubble from dispersing in a direction parallel to the surface of the liquid layer; and liquid supplier means for supplying the liquid to the liquid storage means, the liquid supplier means having a reservoir storing the liquid and a tube connecting the reservoir and the liquid storage means, wherein a height position at which the reservoir is provided is adjusted so that a depth of the liquid stored in the liquid storage means becomes a predetermined value.

Additional objects, features and advantages of the present invention will become apparent from the following detailed description when read in conjunction with the accompanying drawings.

DESCRIPTION OF THE PREFERRED EMBODIMENTS

A description will now be given of a first embodiment of the present invention with reference to FIGS. 1 through 9.

Basic structure

A description will be given of an example of a structure of an ink jet recording head with reference to FIGS. 1 through 5.

Figure 1:
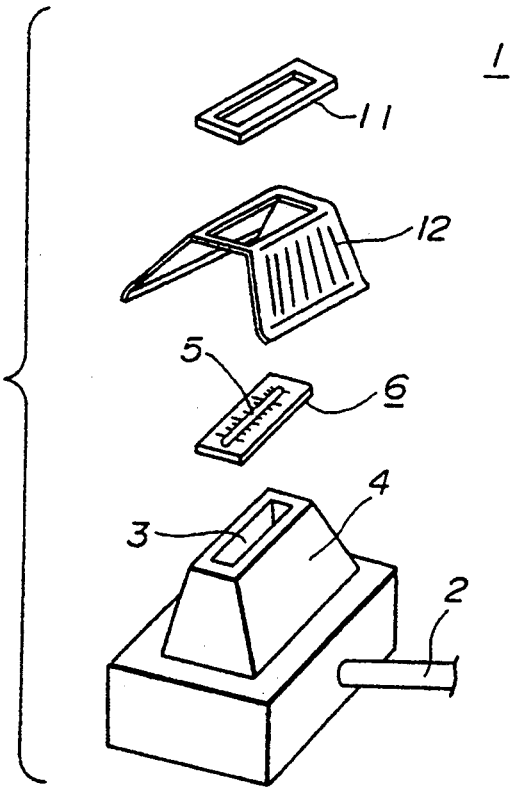
FIG. 1 is a exploded perspective view showing an ink jet recording head according to an embodiment of the present invention.
Figure 2:
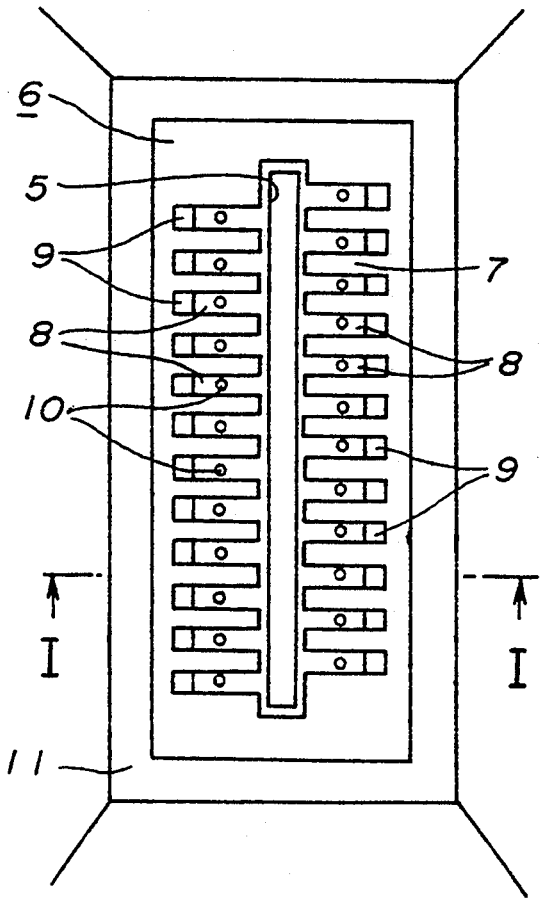
FIG. 2 is a plan view showing the ink jet recording head shown in FIG. 1.
Figure 3:
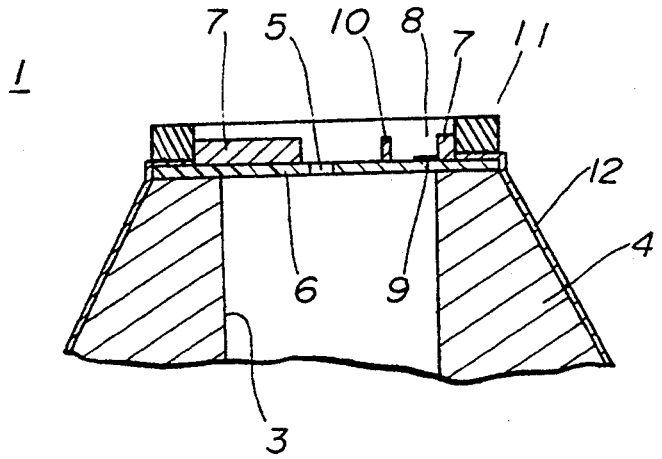
FIG. 3 is a cross sectional view showing the ink jet recording head shown in FIG. 1.

Referring to FIGS. 1 through 3, a recording head 1 has a manifold 4 having a trapezoid shape as a base member. The manifold 4 has an ink supplying cavity 3 which is connected to an ink supplying tube 2. A heater plate 6 on which a slit 5 is formed is provided on the top of the manifold 4 so that the slit 5 is communicated to the ink supplying cavity 3. On the heater plate 6, a plurality of walls 7 are formed at both sides of the slit 5 so that the walls 7 formed at one side of the slit 5 and the walls 7 formed at the other side thereof are alternately arranged. A flow path 8 is formed between the walls 7 adjacent to each other. Each flow path 8 is communicated to the slit 5. A heater element 9 is formed in each flow path 8 formed on the heater plate 6 at a portion far from the slit 5. In a plane view, the heater elements 9 are alternately arranged on the both sides of the slit 5, as shown in FIG. 2. A flow resistance member 10 is formed between the heater element 9 and the slit 5 in each flow path 8 so as to project from the heater plate 6. The height of the flow resistance member 10 is approximately identical to that of each wall 7. A thin film conductive lead 12 is provided on the heater plate 6 and a surrounding portion of the thin film conductive lead 12 is pressed by a frame member 11 so that the thin film conductive lead 12 is fixed on the heater plate 6.

Figure 4:
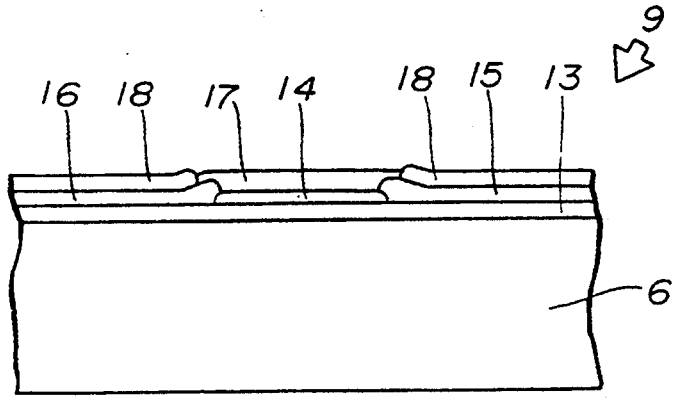
FIG. 4 is a cross sectional view showing the structure of a heater element.
Figure 5A:
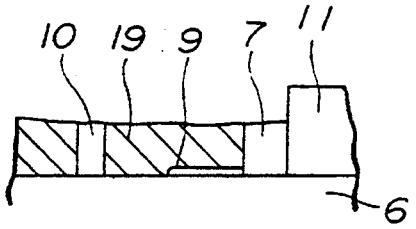
FIGS. 5*a–g* illustrate a process for generating an ink drop.
Figure 5B:
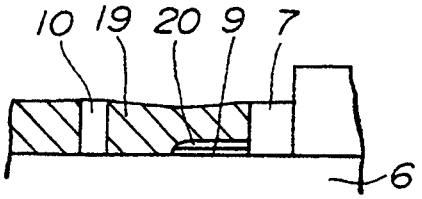
Figure 5C:
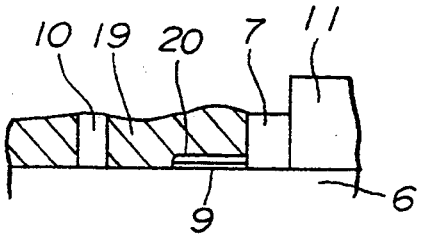
Figure 5D:
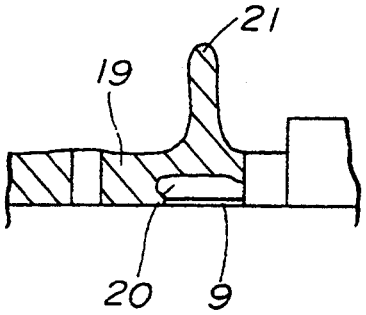
Figure 5E:
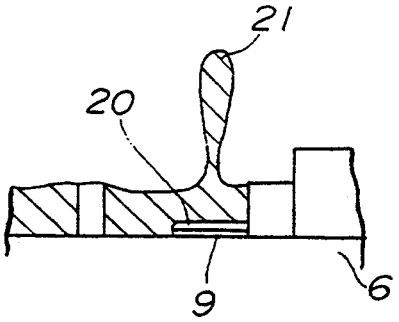
Figure 5F:
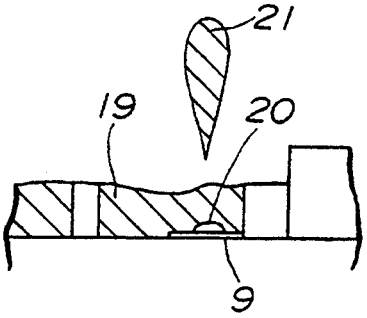
Figure 5G:
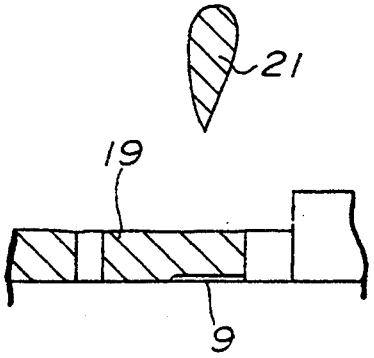
Figure 7A:
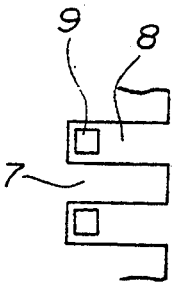
FIGS. 7*a–d* and 8*a–e* are plan views showing the structures of the walls surrounding the heater element.
Figure 7B:
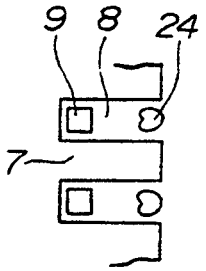
Figure 7C:
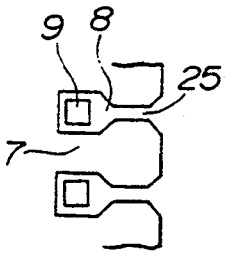
Figure 7D:
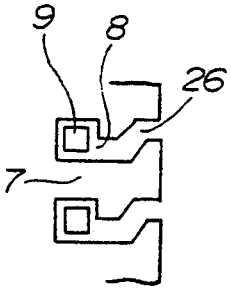
Figure 8A:
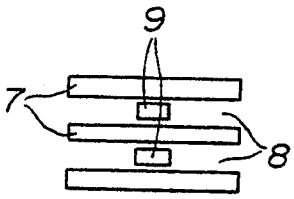
Figure 8B:
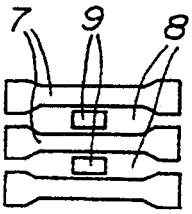
Figure 8C:
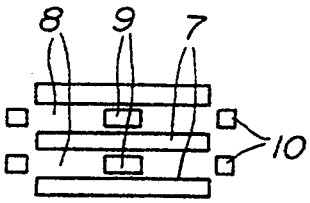
Figure 8D:
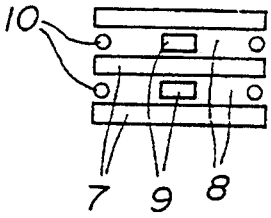
Figure 8E:
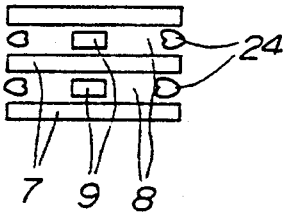

The structure of each heater element 9 and a respective part close to each of the same is shown in FIG. 4.

Referring to FIG. 4, a heat reserve layer 13 is formed on the heater plate 6. A heating layer 14, control electrode 15 and an earth electrode 16 are formed on the heat reserve layer 13. The control electrode 15 and the earth electrode 16 are respectively connected to the heater layer 14. The heater layer 14 is covered by a protection layer 17 and the control electrode 15 and the earth electrode 16 are respectively covered by electrode protection layers 18 so that the heater layer 14, the control electrode 15 and the earth electrode 16 are prevented from being in contact with the ink. An end of a lead wire (not shown in FIG. 4) is bonded on the control electrode 14 or the earth electrode 15 and another end of the lead wire is bonded on the thin film conductive lead 12 so that the heating layer 14 is electrically connected to the thin film conductive lead 12. The thin film conductive lead 12 is connected to an input unit for inputting an image signal (not shown in FIG. 4).

Outline of a principle for making ink fly

When an ink 19 (shown in FIG. 5) is supplied from the ink supplying tube 2 to the ink supplying cavity 3, the ink 19 in the ink supplying cavity 3 moves through the slit 5 into each flow path 8 due to capillarity. Therefore, each flow path 8 is filled with the ink 19. When the width of the slit 5 and the width of each flow path 8 are large, the ink 19 can not be sufficiently supplied to each flow path 8 by use of only capillarity. In this case, each flow path 8 can be filled with the ink 19 by use of a difference between water heads of an ink reservoir tank connected to the ink supplying tube 2 and the ink jet recording head 1. In a stationary state where each flow path 8 is filled with the ink 19 so that the depth of the ink 19 becomes a predetermined depth and each heater element 9 is covered by the ink 19, electric power is supplied to the heating layer 14 in accordance with image information. When electric power is supplied to each heating layer 14, a bubble is generated in the ink 19 existing over the heating layer 14. Thus, a propulsion force based on the generation of the bubble acts on the ink 19 so that the ink 19 flies in a direction substantially perpendicular to the surface of the heater element 9.

Detailed description of a principle for making the ink fly

A detailed description will now be given of the principle for making the ink fly with reference to FIG. 5.

In FIG. 5, the heater element 9 and a surrounding portion are enlarged and the electrodes and the like are omitted for the sake of simplicity.

FIG. 5 (*a*) shows a stationary state. In this stationary state, each flow path 8 is entirely filled with the ink 19 so that the heater element 9 is covered by the ink 19. When the heater element 19 generates heat, the surface temperature of the heater element 9 rapidly increases so that the ink 19 adjacent to the heater element 9 boils and small bubbles 20 are generated on the surface of the heater element 9, as shown in FIG. 5 (*b*). Then, the ink 19 adjacent to the heater element 9 is rapidly heated by the heater element 9 and vaporized instantly so that a boiling film which is a layer of vapor is generated on the surface of the heater element 9, as shown in FIG. 5 (*c*). When the bubble 20 grows up as described above, the surface temperature of the heater element 9 is in a range between 300° C. and 350° C. In the ink 19 existing on the heater element 9, the surface of the ink 19 in the flow path 8 is raised by the propulsion force based on the growth of the bubble 20, as shown in FIG. 5 (*c*). FIG. 5 (*d*) shows a state where the bubble 20 grows further up and the largest bubble is obtained. In this case, an ink column 21 grows up and projects from the surface of the ink 19. The time required for obtaining the largest bubble depends on the structure of the head (heater plate 6), conditions under which the pulse signal is supplied to the head and so on. A time in a range between 5 μsec. and 30 μsec. is generally required for obtaining the largest bubble. When the largest bubble is obtained, no electric power has been supplied to the heater element 9 and the surface temperature of the heater element 9 is decreasing. That is, the time at which the largest bubble is obtained is slightly delayed starting from the time at which the electric pulse supplied to the heater element 9 becomes inactive.

Then, the bubble 20 is cooled by the ink 19 so that contraction of the bubble 20 starts, as shown in FIG. 5 (*e*). The front end portion of the ink column 21 flies at a speed obtained at the time of projection and the back end portion of the ink column 21 is returned into the ink 19 by the contraction of the bubble 20, so that the ink column 21 is constricted in the back end portion, as shown in FIG. 5 (*e*). When the bubble 20 is further contracted, the ink 19 comes in contact with the surface of the heater element 9 and the surface of the heater element 9 is further cooled. Thus, the ink column 21 is separated from the surface of the ink 19 and an ink drop is generated. Then the ink drop flies in a direction of a recording medium (not shown in FIG. 5) at a speed in a range between 2 m/sec. and 10 m/sec. The flying speed of the ink drop depends on the structure of the recording head (heater plate 6), properties of matter of the ink 19, the condition of the electric pulse supplied to the heater element 9 and so on. In a case where the flying speed is smaller, such as 2 m/sec.–3 m/sec., the droplet shaped ink 19 flies, and in a case where the flying speed is larger, such as 7 m/sec.–10 m/sec., the column shaped ink 19 flies. Then, a state of the ink 19 returns to the stationary state as shown in FIG. 5 (*g*). That is, each flow path 8 is filled with the ink 19 and the bubble 20 completely disappears.

According to the flying principle of the ink drop as described above, the following processes (1) through (4) are performed in this sequence.

(1) A bubble is generated by the film boiling of the ink.

(2) The bubble generated in the ink grows up and then the bubble becomes the largest size possible.

(3) The bubble is contracted.

(4) Finally, the bubble disappears into the ink, and then the ink returns to the stationary state.

In the above processes, the ink drop flies after the bubble has become the largest size possible (process (3)).

That is, the bubble 20 is not exploded in the above processes so that there is no ink mist generated by the exploding of the bubble. Thus, the quality of the image formed on the recording sheet is prevented from deteriorating In addition, there is no ink mist scattered from the surface of the ink 19 to form an image on the recording sheet. That is, the ink drop, which is not the ink mist, is adhered onto the surface of the recording sheet as one dot in an image. Thus, a clear image can be formed on the recording sheet.

The structure of the heater plate and a process for forming the same

In this embodiment, the heater plate 6 is one of the most important parts.

The heater plate 6 is, for example, formed of glass, alumina ($Al_2O_3$) or silicon. From the point of view of accuracy and a cost for forming the slit 5, it is desirable that the slit 5 be formed by the laser processing method. When the heater plate 6 is formed of single crystal silicon, the slit 5 is also accurately formed by anisotropic etching processing.

The heat reserve layer 13 provided on the heater plate 6 is, for example, formed of $SiO_2$. When the heater plate 6 is formed of glass or alumina, the heat reserve layer 13 is formed by the thin film forming process, such as the spattering process. When the heater plate 6 is formed of silicon, the heat reserve layer 13 is formed by the thermal oxidation process. The thickness of the heat reserve layer 13 is desirably in a range between 1 μm and 5 μm.

The heating layer 14 is, for example, made of tantalum-$SiO_2$ mixture, tantalum nitride, nickel-chromium alloy, silver-palladium alloy or silicon semiconductor. The heating layer 14 can be also formed of a boride of metals such as hafnium, lanthanum, zirconium, titanium, tantalum, tungsten, molybdenum, niobium, chronium and vanadium. The boride of metals is suited for use as a material of the heating layer 14. Of the materials tested, hafnium boride is most suited for use as the material thereof. Next, zirconium boride, lanthanum boride, tantalum boride, vanadium boride and niobium boride are, in this order, suited for use as the material of the heater layer 14. The heating layer 14 made of the material as described above is formed on the heat reserve layer 13 by a process such as an electron-beam process, an evaporation process or a spattering process. The thickness of the heating layer 14 is determined in accordance with the area thereof, the material forming the heater layer 14, the shape and the size thereof, the power consumed and so on, so that the amount of heat generated from the heater layer 14 for a unit time becomes equal to a predetermined amount of heat. The thickness of the heater layer 14 is normally in a range between 0.001 μm and 5 μm, and desirably in a range between 0.01 μm and 1 μm.

The control electrode 15 and the earth electrode 16 are made of a material normally used for an electrode. That is, the control electrode 15 and the earth electrode 16 are made of a materials such as Al, Ag, Au, Pt, and Cu. The control electrode 15 and the earth electrode 16 are formed on the heat reserve layer 13 so as to be in contact with the heater layer 14 by a process such as the evaporation process.

The protection layer 17 protects the heating layer 14 from the ink 19 without preventing the heat generated from the heating layer 14 from being efficiently transmitted to the ink 19. The protection layer 17 is made of a material such as silicon dioxide ($SiO_2$), silicon nitride, magnesium oxide, aluminum oxide, tantalum oxide and zirconium oxide. The protection layer 17 is formed on the heater layer 14 by a process such as the electron-beam process, the evaporation process or the spattering process. The thickness of the protection layer 17 is normally in a range between 0.01 μm and 10 μm, and desirably in a range between 0.1 μm and 5 μm. The thickness of the protection layer 17 should most desirably be in a range between 0.1 μm and 3 μm. The protection layer 17 has one or a plurality of layers. It is desirable that a metal layer made of Ta or the like be formed on the protection layer 17. The metal layer protects the heater layer 14 from a cavitation which is generated when the bubble 20 is contracted and disappears. The thickness of the metal layer can be in a range between 0.05 μm and 1 μm.

The electrode protection layer 18 is made of a photosensitive polyimide resin such as polyimideisoindroquinazolinedion (PIQ, manufactured by HITACHI KASEI CO. LTD.), polyimide resin (PYRALIN, manufactured by DUPONT CO. LTD.), cyclic polybutadiene (JSR-CBR, manufactured by NIPPON GOSEI GOMU CO. LTD.) or Photoneece (manufactured by TORAY CO. LTD.).

Process for forming the walls 7

Each flow path 8 is formed by the walls 7 provided on the heater plate 6. The walls 7 prevent the pressure in the ink 19 in each flow path 8 from being dispersed in a direction parallel to the surface of the ink 19.

Figure 6A:
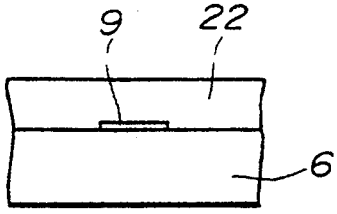
FIGS. 6*a–c* illustrate a process for forming walls on the heater plate.
Figure 6B:
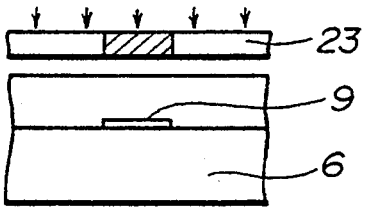
Figure 6C:
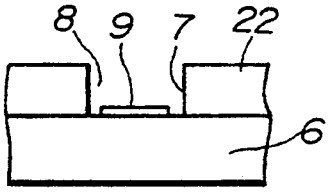

A description will now be given of the process for forming the walls 7 with reference to FIG. 6. In FIG. 6, the heater plate 6 is shown only with the heater element 9 for the sake of simplicity.

A dry film photo-resist 22 which is heated to a temperature in a range between 80° C. and 105° C. is laminated on the heater plate 6. Then the dry film photo-resist 22 is pressed on the heater plate 6 under a condition of 0.4–0.5 f/min. and 1–3 Kg/cm$^2$. Thus, the dry film photo-resist 22 having a thickness of 10 μm–100 μm is formed on the heater plate 6 having the heater element 9, as shown in FIG. 6 (*a*). The surface of the dry film photo-resist 22 which is in contact with the heater plate 6 is fused so that the dry film photo-resist 22 is fixed on the heater plate 6.

Next, a photo mask 23 is provided over the dry film photo-resist 22, as shown in FIG. 6 (*b*). The photo mask 23 has a predetermined masking pattern which intercepts a light irradiating thereon. The photo mask 23 is accurately located over the dry film photo-resist 22 by a well known method so that the masking pattern shades the heater element 9 on the heater plate 6. The light is projected onto the photo mask 23 so that the dry film photo-resist 22 is exposed to the light via the photo mask 23.

After exposure of the dry film photo-resist 22, a part of the dry film photo-resist 22, where the masking pattern shades, is dissolved by a developer including organic solvent such as trichloroethane. As a result, the walls 7 remain on the heater plate 6 so that each flow path 8 surrounded by the wall 7 is formed, as shown in FIG. 6 (*c*). The heater element 9 is exposed on the bottom surface of each flow path 8. Either a heat curing process or an ultraviolet projection process is performed In the heat curing process, the walls 7 are heated to a temperature in a range between 150° C. and 250° C. for a time in a range between 30 minutes and 60 minutes. In the ultraviolet projection process, ultraviolet having an intensity in a range between 50 mW/cm$^2$ and 200 mW/cm$^2$ is projected onto the surface of the walls 7. Both the heat curing process and the ultraviolet projection process can be also performed. Due to the heat curing process or the ultraviolet projection process, an ink-proof property of the walls 7 (the dry film photo-resist 22) and adhesion between the dry film photo-resist 22 and the heater plate 6 are respectively improved.

The masking pattern in the photo mask 23 can be formed so that the walls 7 and the flow resistance members 10 are formed at the same time.

It is possible to use a liquefied photosensitive composition instead of the dry film photo-resist 22. In a case of where the liquefied photosensitive composition is used, walls having a predetermined height is provided along the edge of the heater plate 6 and then the liquefied photosensitive composition is supplied to an area surrounded by the walls. Excessive liquefied photosensitive composition is removed by a squeeze process. Viscosity of the liquefied photosensitive composition should desirably be in a range between 100 cp and 300 cp. The height of the wall is determined on the basis of the amount of the liquefied photosensitive composition when a solvent therein is vaporized.

It is desirable that the dry film be used for the photo-resist as described above. The walls are formed of the following solid materials.

A photosensitive resin such as Permanent-photopolymercorting RISTON (SOLDER MASK) 730S, 740S, 730FR, 740FR and SM (manufactured by DUPONT) is used as a material for the walls. Each of the following photosensitive compositions is also used as a material for the walls. That is, the photosensitive compositions are diazo resin, P-diazo quinone, photo polymerization type photopolymers made by use of vinyl monomer and polymerization initiators, dimerization type photopolymers made by use of polyvinyl cinnamate and the sensitizers, mixture of o-naphthoquinone azide and novolac type phenol resin, polyether type photopolymers obtained by a copolymerization of 4-glycidylethyleneoxide and either benzophenone or glycidylcalcone, copolymer made of N,N-dimethylmethacrylic amide and acrylamidebenzophenone, unstaturated polyester type photosensitive resins (for example, APR manufactured by ASAHI KASEI CO. LTD, TEVISTA manufactured by TEIJIN CO. LTD, ZONNE manufactured by KANSAI PAINT CO. LTD and so on), unstaturated urethane oligomer type photosensitive resins, photosensitive composition obtained by polymerization of bi-functional acrylmonomer, photopolymerization initiators and polymer, bichromate type photo-resist, non-chromium type water soluble photo-resist, polycynnamic acide vinyl type photo-resist and cyclized rubber-azide type photo-resist.

Modification a. The flow paths 8:

FIG. 7 (*a*) (*b*) (*c*) (*d*) are respectively plan views showing each flow path 8.

The flow resistance member 10 is omitted from the flow path in FIG. 7 (*a*). It is possible to accurately make an ink drop fly from the flow path 8 without the flow resistance member 10 when properties of the matter of the ink 19 and the driving condition of the ink jet recording head are suitably determined.

In FIG. 7 (*b*), a flow resistance member 24 having a heart shaped cross section is provided in each flow path 8. That is, an area of the flow resistance member 24 in a direction perpendicular to the extension of each flow path 8 increases in a direction from an inlet of each flow path 8 toward the heater element 9. Thus, the ink 19 can easily flow into each flow path 8 via the flow resistance member 24, but it is difficult for the ink 19 to flow out via the resistance member 24.

In FIG. 7 (*c*), the flow resistance member 10 is omitted from each flow path 8. Each flow path 8 has a narrow inlet portion. EACH narrow inlet portion is referred to as a flow resistance portion 25. The width of the flow resistance portion 25 is narrower than that at a position where the heater element 9 is provided. It is difficult for the ink 19 to flow into the flow resistance portion 25.

Figure 9:
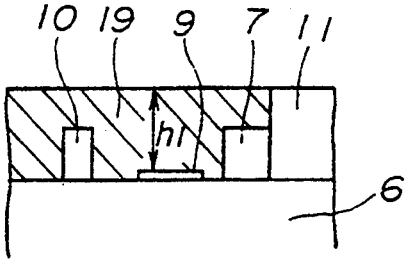
FIG. 9 is a cross sectional view showing the depth of the ink supplied on the heater element.
Figure 10A:
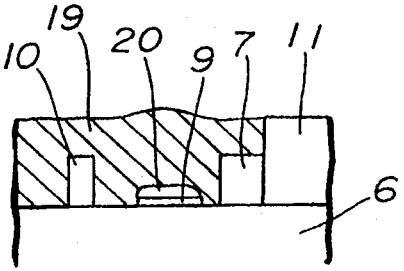
FIGS. 10*a–e* illustrate a process for generating an ink drop.
Figure 10B:
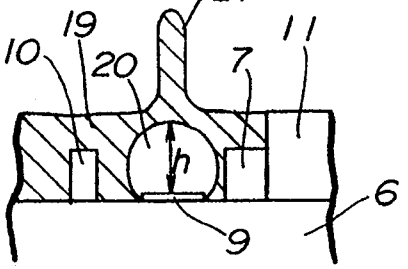
Figure 10C:
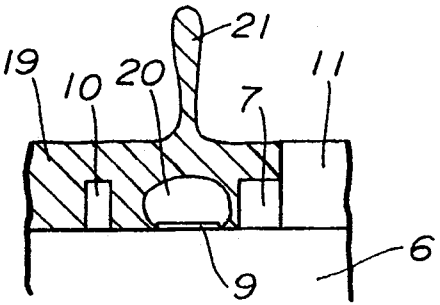
Figure 10D:
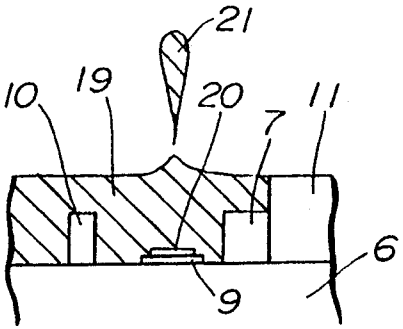
Figure 10E:
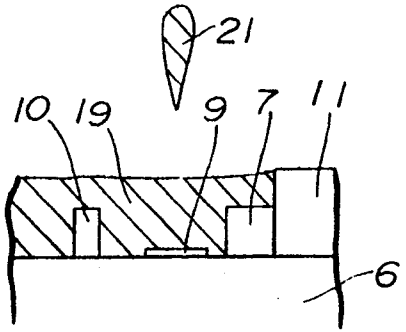

In FIG. 7 (*d*), the flow path 8 has a bent inlet portion. The flow path 8 is bent at the bent inlet portion. The bent inlet portion is also referred to as a flow resistance portion 26. It is also difficult for the ink 19 to flow into the flow resistance portion 26.

b. The walls 7:

Walls 7 separated from each other can be provided on the heater plate 6, as shown in FIG. 8 (*a*) (*b*) (*c*) (*d*) (*e*). Each flow path 8 is formed between walls 7 adjacent to each other. The walls 7 can be shaped so that each flow path 8 having the same shape as that shown in FIG. 7 is obtained. In the cases shown in FIG. 8, the flow resistance member 10 can be provided in each flow path 8 on omitted from each flow path 8.

c. The depth of the ink 19:

In FIG. 5, the depth of the ink 19 is substantially equal to the height of the wall 7 and flow resistance member 10. It is also possible for the depth of the ink 19 to differ from the height of the wall 7. In FIG. 9, each of the walls 7 and each of the flow resistance members 10 are put under the ink 19. In this case, the ink drop can accurately fly due to the matter of the ink having suitable properties and conditions of the electric pulse supplied to the heater element 9.

Energy supplying means:

In the above embodiment, the heater element 9 having the heating layer 14 is used as an energy supplying means for supplying energy to the ink so that the bubble 20 is generated in the ink 19. The energy can also be supplied to the ink 19 by a pulse laser or an electric discharging.

An example of a system in which the pulse laser supplies energy to the ink 19 is disclosed in Japanese Laid-Open Patent Application No.1-184148.

An example of a system in which the energy is supplied to the ink by electric discharging is also disclosed in Japanese Laid-Open Patent Application No. 1-184148.

e. The ink 19:

It is necessary for the ink 19 to have properties which are generally required for the ink used in the ink jet recording head. For example, the ink having the properties disclosed in Japanese Laid-Open Patent Application No. 1-184148 is suited for the ink used in the ink jet recording head according to the present invention.

Experiments

In Experiment 1, a dot image was recorded on a recording sheet under the following conditions.

| | |
|---|---|
| SIZE OF HEATING LAYER 14 | 65 μm × 65 μm |
| DENSITY OF HEATER ELE- | 180 dpi |

-continued

| | |
|---|---|
| MENTS 9 | |
| THE NUMBER OF HEATER ELEMENTS 9 | 30 |
| RESISTANCE OF HEATER ELEMENT 9 | 31 ohm |
| SHAPE OF THE WALL 7 | SHOWN IN FIG. 7 (a) |
| SIZE OF THE WALL 7 | WIDTH 65 μm<br>LENGTH 120 μm<br>HEIGHT 35 μm |
| DRIVING VOLTAGE | 15 V |
| PULSE WIDTH | 5 usec. |
| CONTINUOUS DRIVING FREQUENCY | 2 kHz<br>(SOLID PRINTING) |
| INK | INK USED IN BJ130<br>(CANON CO. LTD) |

The dot image was formed on the matted coat sheet NM (manufactured by MITSUBISHI SEISHI CO. LTD). The mean value of the diameters of ink dots adhered on the sheet was 95 μm. When the driving was continuous at 2 kHz, the flying speed of each ink drop was 4.5 m/sec.. That was, it was possible to rapidly print a dot image on the sheet.

In Experiment 2, a dot image was recorded on a recording sheet under the following conditions.

| | |
|---|---|
| SIZE OF HEATING LAYER 14 | 65 μm × 62 μm |
| DENSITY OF HEATER ELEMENTS 9 | 300 dpi |
| (The heater elements were alternately arranged in two lines, as shown in FIG. 2. In each line, the heater elements were arranged at 150 dpi.) | |
| THE NUMBER OF HEATER ELEMENTS 9 | 50 |
| RESISTANCE OF HEATER ELEMENT 9 | 31 ohm |
| SHAPE OF THE WALL 7 | SHOWN IN FIG. 7 (c) |
| SIZE OF THE WALL 7 | WIDTH 65 μm<br>LENGTH 100 μm<br>HEIGHT 20 μm<br>WIDTH OF NARROW INLET<br>PORTION 30 μm |
| DRIVING VOLTAGE | 15 V |
| PULSE WIDTH | 3.6 usec. |
| CONTINUOUS DRIVING FREQUENCY | 4 kHz<br>(SOLID PRINTING) |
| INK | INK USED IN BJ130<br>(CANON CO. LTD) |

In this case, a fine dot image was obtained. The mean value of the diameter of the ink dots adhered on the matted coat sheet NM (manufactured by MITSUBISHI SEISHI CO. LTD) was 90 μm. When the driving was continuous at 4 kHz, the ink drops accurately flew at a speed of 5 m/sec.

In Experiment 3, the walls 7 were formed as shown in FIG. 8 (C). The conditions were identical to those of Experiment 2. In this case, the ink drops accurately flew at a speed of 5.5 m/sec.

Experiment 4

In Experiment 4, the conditions were identical to those of Experiment 3. The walls 7 and the flow resistance members 10 were respectively put under the ink 19, as shown in FIG. 9. In this case, when the driving was continuous at 4 kHz, the ink drops accurately flew at a speed of 5 m/sec.

An optimum relationship between the depth of the ink 19 and the height of the largest bubble obtained by the growth of the bubble 20 was experimentally obtained.

In the ink jet recording head having the structure as shown in FIG. 9, the depth of the ink on the heater element 9 was changed and then the ink drops flew under the following conditions.

In Experiment 5, the conditions were identical to those of Experiment 2.

| | |
|---|---|
| SIZE OF HEATING LAYER 14 | 65 μm × 62 μm |
| RESISTANCE OF HEATER ELEMENT 9 | 31 ohm |
| DRIVING VOLTAGE | 15 V |
| PULSE WIDTH | 3.6 μsec. |
| CONTINUOUS DRIVING FREQUENCY | 4 kHz<br>(SOLID PRINTING) |
| INK | INK USED IN BJ130<br>(CANON CO. LTD) |
| RECORDING SHEET | MATTED COAT SHEET NM (MITSUBISHI SEISHI CO. LTD) |

Experiment 6

The ink drops flew under the following conditions.

| | |
|---|---|
| SIZE OF HEATING LAYER 14 | 110 μm × 100 μm |
| RESISTANCE OF HEATER ELEMENT 9 | 65 ohm |
| DRIVING VOLTAGE | 25 V |
| PULSE WIDTH | 6 μsec. |
| CONTINUOUS DRIVING FREQUENCY | 1.25 kHz |
| INK | INK USED IN BJ130 (CANON CO. LTD) |
| RECORDING SHEET | MATTED COAT SHEET NM (MITSUBISHI SEISHI CO. LTD) |

In Experiment 5, when the depth $h_1$ of the ink 19 was either 20 μm, 25 μm, 30 μm, 40 μm, 50 μm or 60 μm, a dot formed on the recording sheet had a substantially circular shape. That is, a fine image was obtained. When the depth $h_1$ of the ink 19 was either 10 μm or 15 μm, an image having small dispersed ink dots was formed on the recording sheet. That is, the quality of the image formed on the recording sheet deteriorated.

In Experiment 6, when the depth $h_1$ of the ink 19 was either 25 μm, 30 μm, 40 μm, 60 μm, 60 μm or 70 μm, a dot formed on the recording sheet had a substantially circular shape. That is, a fine image was obtained. On the other hand, when the depth $h_1$ of the ink 19 was either 10 μm or 20 μm, an image having small dispersed ink dots was formed on the recording sheet. That is, the quality of the image formed on the recording sheet deteriorated.

According to Experiments 5 and 6, when the depth $h_1$ of the ink 19 is too shallow, the image having dispersed small dots is formed on the recording sheet so that the quality of the image deteriorates. Therefore, it is desirable that the depth of the ink 19 be equal to or larger than a predetermined value. In an ink jet recording head as shown in FIG. 9, a depth of the ink 19 suitable for forming a fine image can be obtained due to an adjusting of the height of a supporting member 11. In an ink jet recording head as shown in FIG. 5, a depth of the ink 19 suitable for forming the fine image can be obtained due to the adjusting of the height of the wall 7 and the height of the flow resistance member 10.

In addition, in Experiments 5 and 6, a transparent vehicle was substituted for the ink used for BJ130 and manufactured by CANON CO. LTD. The matter of the transparent vehicle has the same properties as the ink used for BJ130. Then, the shape of the flying ink and the state of the bubble formed in the ink were observed by use of a stroboscope driven in synchronism with the driving signal for the ink jet recording head. As a result, when the largest bubble was obtained in an ink jet recording head used in Experiment 5 (referred to FIG. 10 (*b*)), the height $h_2$ of the largest bubble was equal to 25 μm ($h_2$=25μm). In an ink jet recording head used in Experiment 6, the height $h_2$ of the largest bubble was equal to 30 μm ($h_2$=30 μm). In these cases, the state of the flying ink is indicated in the following Table-1.

TABLE 1

| HEAD | $h_1$ (μm) | $h_1/h_2$ | SHAPE OF FLYING INK | STABILITY OF FLYING INK |
|---|---|---|---|---|
| EXP. 5 | 10 | 0.4 | mist shaped | x |
| | 15 | 0.6 | mist shaped | x |
| | 20 | 0.8 | column shaped | ∘ |
| | 25 | 1.0 | column shaped | ◎ |
| | 30 | 1.2 | column shaped | ◎ |
| | 40 | 1.6 | column shaped | ◎ |
| | 50 | 2.0 | column shaped | ◎ |
| | 60 | 2.4 | drop shaped | ∘ |
| EXP. 6 | 10 | 0.3 | mist shaped | x |
| | 20 | 0.7 | mist shaped | x |
| | 25 | 0.8 | column shaped | ∘ |
| | 30 | 1.0 | column shaped | ◎ |
| | 40 | 1.3 | column shaped | ◎ |
| | 50 | 1.7 | column shaped | ◎ |
| | 60 | 2.0 | column shaped | ◎ |
| | 70 | 2.3 | drop shaped | ∘ |

x: very insecurity
∘: stabilized
◎: very stabilized

Referring to Table-1, when $h_1/h_2$ is equal to or greater than 0.8 ($h_1/h_2 \geqq 0.8$), the column shaped ink or the drop shaped ink flies to the recording sheet. On the other hand, when $h_1/h_2$ is less than 0.8 ($h_1/h_2 < 0.8$), the mist shaped ink is dispersed. Therefore, it is desirable that the depth $h_1$ of the ink 19 on the heater element 9 be equal to or greater than ($0.8 \times h_2$) and it is even more desirable that the depth $h_1$ of the ink be equal to or greater than the height $h_2$ of the largest bubble. The column shaped ink or the drop shaped ink can fly in a stabilized direction and at a stabilized speed. However, the mist shaped ink flies very insecurely so that it is impossible for it to fly in synchronism with the operation of the stroboscope.

When the column shaped or the drop shaped ink flies, the bubble 20 in the ink 19 is generated, the generated bubble grows, and the bubble 20 is contracted and then disappears, in accordance with the process for forming the film boiling, as shown in FIG. 10. That is, the surface of the ink 19 rises up as shown in FIG. 10 (*a*), the ink column grows as shown in FIG. 10 (*b*), the bottom portion of the ink column is constricted as shown in FIG. 10 (*c*), the ink column is cut as shown in FIG. 10 (*d*) and then the ink returns to the stationary state as shown in FIG. 10 (*e*). While the above process is being performed, the ink bubble 20 is not exploded and the ink flies.

Figure 47:
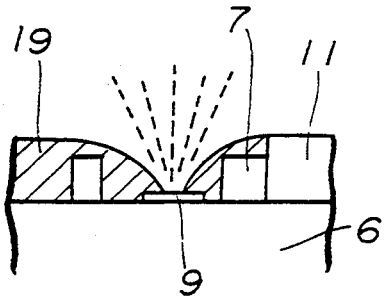
FIGS. 47 and 48 are diagrams illustrating states where the ink mists are dispersed.

When the ink layer is too thin, the ink on the heater element 9 is boiled instantly by the heat so that the ink mist is dispersed as shown in FIG. 47 This action of the ink is identical to that indicated in Japanese Laid-Open Patent Application No. 1-101157 described above.

When $0.8 \geqq h_1/h_2 \leqq 1$, the surface of the ink rises with the growth of the bubble 20 and the height $h_2$ of the largest bubble is equal to or greater than the depth $h_1$ of the ink in the stationary state. In this case, a surface tension of the ink prevents the bubble 20 from being exploded.

According to the embodiment described above, in the ink jet recording head which does not have nozzles and in which the surface of the ink provided therein is not divided for every heater element 9, the ink mist is not generated and it is possible for the ink to fly in a stabilized state. In addition, the film boiling is generated on the surface of the heater element 9 in a stabilized state so that it is possible for the ink jet recording head to drive at a high frequency.

Next, an optimum condition of a cycle of the driving signal for recording an image at a high speed was found as the result of the following Experiments 7 and 8.

Figure 11:
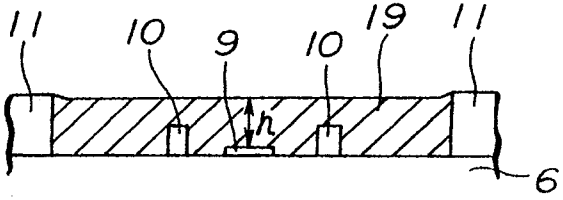
FIG. 11 is a cross sectional view showing the depth of the ink supplied on the heater element.
Figure 12D:
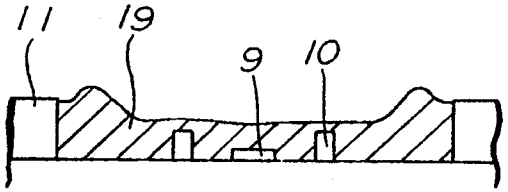
FIGS. 12*a–e* illustrate a process for generating an ink drop.
Figure 12E:
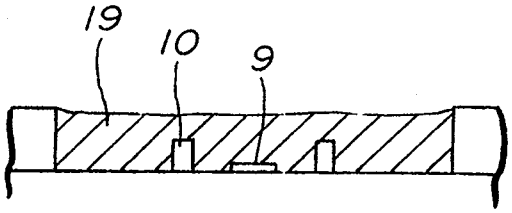
Figure 12A:
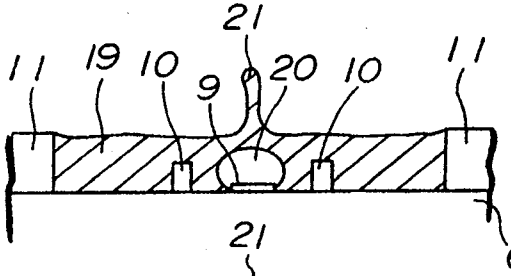
Figure 12B:
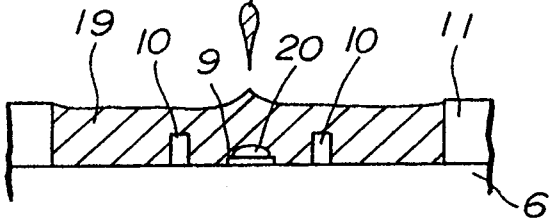
Figure 12C:
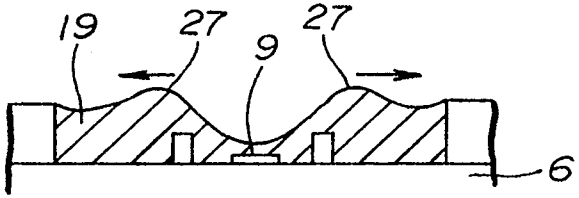

In the ink jet recording head used in Experiments 7 and 8, the heater element 9, the flow resistance members 10 and the supporting members 11 were respectively provided on the heater plate 6 as shown in FIG. 11. The flow resistance members 10 were put under the ink 19.

In Experiment 7, there were three kinds of driving pulse signal supplied to the heater element 9. A first driving pulse had a first width so that a half width of an energy pulse supplied from the heater element was 6 μsec, a second driving pulse had a second width so that a half width of the energy pulse supplied from the heater element was 10 μm, and a third driving pulse had a third width so that a half width of the energy pulse supplied from the heater element was 20 μm. A cycle of each driving pulse signal supplied to the heater element 9 was changed into either 20 μsec., 30 μsec., 40 μsec., 60 μsec., 100 μsec., 500 μsec. or 1 msec. That is, a frequency of each driving pulse signal was changed into 50 kHz, 33.3 kHz, 25 kHz, 16.7 kHz, 10 kHz, 2 kHz and 1 kHz. The voltage of the pulse signal supplied to the heater element 9 was less than a maximum voltage therefor. The ink drops flew under the following conditions which were identical to those in Experiment 6.

| | |
|---|---|
| SIZE OF HEATING LAYER 14 | 110 μm × 100 μm |
| RESISTANCE OF HEATER ELEMENT 9 | 65 ohm |
| INK | INK USED IN BJ130 (CANON CO. LTD) |
| RECORDING SHEET | MATTED COAT SHEET NM (MITSUBISHI SEISHI CO. LTD) |

In Experiment 7, images having the quality indicated in Table-2 were formed on the recording sheet.

In Experiment 8, the ink drops flew from the ink jet recording head as shown in FIG. 11 under the following conditions.

| | |
|---|---|
| SIZE OF HEATING LAYER 14 | 65 μm × 62 μm |
| RESISTANCE OF HEATER ELEMENT 9 | 31 ohm |
| INK | INK USED IN BJ130 (CANON CO. LTD) |
| RECORDING SHEET | MATTED COAT SHEET NM (MITSUBISHI SEISHI CO. LTD) |

In Experiment 8, there were also three kinds of driving pulse signal supplied to the heater portion. A first pulse signal had a first width so that a half width of the energy pulse supplied from the heater element was 3 μsec., a second pulse signal had a second width so that a half width of the energy pulse supplied from the heater element was 8 μsec., and a third pulse signal had a third width so that a half width of the energy pulse supplied from the heater element was 20 μsec. A cycle of each driving pulse signal supplied to the heater element 9 was changed into 10 μsec., 30 μsec., 40 μsec., 50 μsec., 100 μsec., 500 μsec. and 1 msec. That is, a frequency of each pulse signal was changed into 100 kHz, 33.3 kHz, 20 kHz, 10 kHz, 2 kHz and 1 kHz.

In Experiment 8, images having the quality indicated in Table-3 were formed on the recording sheet.

TABLE 2

| HALF WIDTH | CYCLE (μsec.) | VOLTAGE (v) | QUALITY OF IMAGE |
|---|---|---|---|
| 6 μsec. | 20 | 10 | x (ink mist) |
| | 30 | 11 | x (ink mist) |
| | 40 | 13 | ○ |
| | 60 | 15 | ◎ |
| | 100 | 20 | ◎ |
| | 500 | 25 | ◎ |
| | 1000 | 25 | ◎ |
| 10 μsec. | 20 | 8 | x (not in synchronism with the driving pulse signal; ink mist) |
| | 30 | 10 | x (ink mist) |
| | 40 | 11 | ○ |
| | 60 | 12 | ◎ |
| | 100 | 14 | ◎ |
| | 500 | 25 | ◎ |
| | 1000 | 25 | ◎ |
| 20 μsec. | 10 | 6 | x (not in synchronism with the driving pulse signal; ink mist) |
| | 30 | 6 | x (not in synchronism with the driving pulse signal; ink mist) |
| | 40 | 8 | x (ink mist) |
| | 60 | 9 | ○ |
| | 100 | 11 | ◎ |
| | 500 | 22 | ◎ |
| | 1000 | 25 | ◎ |

x: bad
○: fine
◎: very fine

TABLE 3

| HALF WIDTH | CYCLE (usec.) | VOLTAGE (v) | QUALITY OF IMAGE |
|---|---|---|---|
| 3 μsec. | 10 | 6 | x (not in synchronism with the driving pulse signal; ink mist) |
| | 30 | 12 | x (ink mist) |
| | 40 | 13 | ○ |
| | 50 | 14 | ○ |
| | 100 | 15 | ◎ |
| | 500 | 15 | ◎ |
| | 1000 | 15 | ◎ |
| 8 usec. | 10 | 5 | x (not in synchronism with the driving pulse signal; ink mist) |
| | 30 | 7 | x (not in synchronism with the driving pulse signal; ink mist) |
| | 40 | 8 | ○ |
| | 50 | 9 | ○ |
| | 100 | 13 | ◎ |

TABLE 3-continued

| HALF WIDTH | CYCLE (usec.) | VOLTAGE (v) | QUALITY OF IMAGE |
|---|---|---|---|
| | 500 | 15 | ◎ |
| | 1000 | 15 | ◎ |
| 20 usec. | 10 | 3 | x (not in synchronism with the driving pulse signal; ink mist) |
| | 30 | 4 | x (not in synchronism with the driving pulse signal; ink mist) |
| | 40 | 5 | x (ink mist) |
| | 50 | 6 | ◎ |
| | 100 | 8 | ◎ |
| | 500 | 15 | ◎ |
| | 1000 | 15 | ◎ |

x: bad : fine : very fine

Referring to Table-2 and Table-3, when the cycle of the driving pulse signal is equal to or greater than t+30 μsec., and even more desirably equal to or greater than t+50 μsec., where t is the half width of the pulse signal, a fine image is formed on the recording sheet.

In addition, in Experiments 7 and 8, a transparent vehicle was substituted for the ink used for BJ130 and manufactured by CANON CO. LTD. The matter of the transparent vehicle has the same properties as the ink used for BJ130. Then, the shape of the flying ink and the state of the bubble formed in the ink were observed by use of stroboscope driven in synchronism with the driving signal for the ink jet recording head. The shape of the flying ink and the state of the bubble obtained are shown in FIG. 12.

Referring to FIG. 12, the bubble 20 generated on the surface of the heater element 9 grows and the bubble 20 expands to the largest possible size so that the ink column 21 projects from the surface of the ink 19, as shown in FIG. 12 (*a*). When the bubble 20 is contracted, the ink column 21 is separated from the surface of the ink 19 and flies, as shown in FIG. 12 (*b*). When the bubble 20 disappears, the surface of the ink 19 on the heater element 9 falls from the level of the surface thereof in the stationary state which is indicated by h in FIG. 11, as shown in FIG. 12 (*c*). At this time, a wave 27 is formed on the surface of the ink 19 and spreads from a position corresponding to the heater element 9. In FIG. 12 (*c*), the wave 27 spreads in directions indicated by arrows. The wave 27 further spreads as shown in FIG. 12 (*d*), and then the surface of the ink 19 on the heater element 9 rises. When the wave 27 disappears, the ink 19 returns to the stationary state.

Due to an action of the ink 19 as shown in FIG. 12, the following matters was ascertained.

The surface of the ink 19 on the heater element 9 fell so that the ink 19 had a depth which was 20%–80% of the depth thereof in the stationary state. The bubble disappeared 10 μsec. after the driving pulse was turned off. The state of the ink which flew under conditions as shown in Table-2 and Table-3 was observed by use of the stroboscope. As a result, in a case where the cycle T of the driving pulse supplied to the heater element 9 was equal to or greater than (t+30) μsec., where t was the half width, when the driving pulse became active, the wave spread far from the heater element 9, and the depth of the ink on the heater element 9 returned to the substantially stationary state (equal to or greater than 0.8 h, where h was the depth of the ink in the stationary state). While the bubble was repeatedly generated, made to grow, contracted and made to disappear, a process for making the ink fly was repeatedly performed in synchronism with the driving pulse signal in a stabilized state. In this process for making the ink fly, first, the surface of the ink rose, second, the ink column 21 grew, third, the bottom portion of the ink column 21 was contracted, fourth, the ink column 21 was separated from the surface of the ink 19, and fifth, the ink returned to the stationary state, as shown in FIG. 12.

Figure 48:
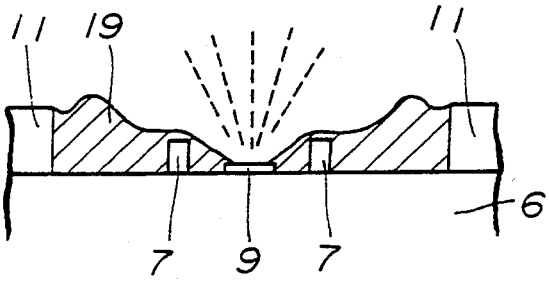

On the other hand, in a case where the cycle T of the driving pulse signal was less than (t +30) μm, when the driving pulse signal became active, the wave was present close to the heater element 9 and the heater element 9 was driven under a condition in which the ink 19 on the heater element was too thin. As a result, the ink 19 on the heater element 9 was boiled instantly so that the ink mist was dispersed as shown in FIG. 48. This action of the ink is identical to that indicated in Japanese Laid-Open Patent Application No. 1-101157 described above.

In the ink jet recording head in which there is no nozzle and the surface of the ink 19 is not divided for each heater element 9, the wave is generated on the surface of the ink 19 when the ink column is separated from the surface of the ink 19. Thus, the ink on the heater element 9 becomes thin due to the wave generated on the surface of the ink 19. In the above embodiment, the heater element is driven by the driving pulse signal having the optimum cycle so that the ink on the heater element is prevented from being too thin when the heater element is turned on.

Next, the depth of the ink 19 on the heater element 9 is optimized by use of the height of the ink column 21 projecting from the surface of the ink 19.

Figure 13:
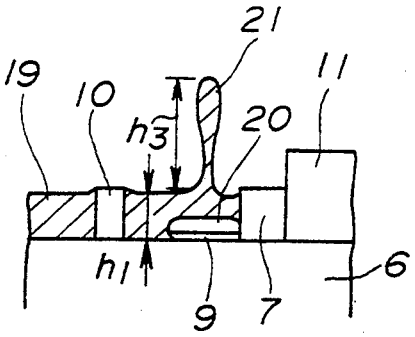
FIGS. 13 and 14 are diagrams illustrating relationships between the depth of the ink on the heater element and the length of the ink column projecting from the surface of the ink.

In FIG. 13 showing the state in which the ink column projects from the surface of the ink, the depth of the ink 19 on the heater element 9 is indicated by $h_1$ and the height of the ink column 21 projecting from the surface of the ink 19 is indicated by $h_3$. The height of the ink column 21 is measured immediately before the bottom of the ink column 21 is cut.

In the ink jet recording head as shown in FIG. 13, the depth $h_1$ of the ink was changed into various values and the Experiments 9 and 10 for making the ink fly were performed.

The conditions of Experiment 9 for forming an image were identical to those of Experiment 5, and the conditions of Experiment 10 for forming an image were identical to those of Experiment 6. In both Experiments 9 and 10, the matter of the vehicle had the same properties as the ink used in BJ130 manufactured by CANON CO. LTD. The results of Experiments 9 and 10 are indicated in Table-4.

TABLE 4

| HEAD | $h_1$ (μm) | $h_3$ (μm) | SHAPE OF FLY. INK | SPEED OF FLY. INK (m/s) | STA-BIL-ITY |
|---|---|---|---|---|---|
| EXP. 9 | 20 | 700 | column shape | 15 | ○ |
| | 25 | 700 | column shape | 15 | ◎ |
| | 30 | 700 | column shape | 15 | ◎ |
| | 40 | 660 | column shape | 14 | ◎ |
| | 50 | 600 | column shape | 14 | ◎ |
| | 60 | 440 | column shape | 8 | ○ |
| | 100 | 170 | drop shape | 2 | Δ |
| | 130 | 150 | drop shape | 1.5 | Δ |
| | 200 | 100 | does not fly | — | — |
| EXP. 10 | 25 | 750 | column shape | 16 | ∘ |
| | 30 | 750 | column shape | 15.5 | ◎ |
| | 40 | 700 | column shape | 15 | ◎ |

TABLE 4-continued

| HEAD | $h_1$ (μm) | $h_3$ (μm) | SHAPE OF FLY. INK | SPEED OF FLY. INK (m/s) | STA-BIL-ITY |
|---|---|---|---|---|---|
| | 50 | 600 | column shape | 13 | ◎ |
| | 60 | 600 | column shape | 13 | ◎ |
| | 70 | 580 | column shape | 12 | ○ |
| | 100 | 500 | column shape | 7 | ○ |
| | 200 | 250 | drop shape | 1 | Δ |
| | 300 | 40 | doed not fly | — | — |

◎, ∘ and Δ respectively indicate various estimations of the stability.
◎: very good
○: good
Δ: somewhat inferior Referring to Table-4, it is found that the ink flies in a stabilized state when the depth $h_1$ of the ink 19 of the heater element 9 is less than the height $h_3$ of the ink column 21. Especially, when $h_3$ is equal to or greater than 5 $h_1$, the ink can fly at a high speed in a stabilized state.

Figure 14:
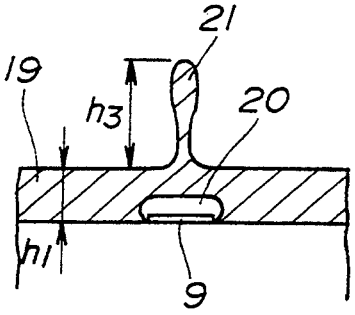

In an ink jet recording head shown in FIG. 14, the walls 7 and the flow resistance members 10 are respectively omitted. In the ink jet recording head, Experiments 11 and 12 were performed under the same conditions as Experiments 9 and 10. The results of the Experiments 11 and 12 are indicated in Table-5.

TABLE 5

| HEAD | $h_1$ (μm) | $h_3$ (μm) | SHAPE OF FLY. INK | SPEED OF FLY. INK (m/s) | STA-BIL ITY |
|---|---|---|---|---|---|
| EXP. 11 | 20 | 600 | column shape | 13 | ○ |
| | 30 | 540 | column shape | 13 | ◎ |
| | 50 | 530 | column shape | 12 | ◎ |
| | 70 | 360 | column shape | 8 | ○ |
| | 100 | 120 | drop shape | 1.3 | Δ |
| | 130 | 50 | does not fly | — | — |
| EXP. 12 | 50 | 700 | column shape | 14 | ◎ |
| | 120 | 640 | column shape | 12 | ◎ |
| | 170 | 260 | drop shape | 2 | Δ |
| | 200 | 120 | does not fly | — | — |

◎, ○ and Δ respectively indicate various estimations of the stability.
◎: very good
○: good
Δ: somewhat inferior In these cases, the ink can fly in a stabilized state when the depth $h_1$ of the ink 19 is less than the height $h_3$ of the ink column 21. Especially, when $h_3 \geqq 5\ h_1$, the ink can fly at a high speed in a stabilized state.

The depth $h_1$ of the ink 19 on the heater element 9 must be maintained at a predetermined value as described above. In an ink jet recording head shown in FIG. 15, the depth of the ink is maintained constant by a meniscus generated on a solid-liquid surface between the wall 7 and the ink 19. That is, the wall 7 has a first function which prevents pressure from dispersing in a direction parallel to the surface of the ink 19 and a second function which maintains the depth of the ink on the heater element 9 at a constant depth. In this case, the height of the wall 7 is adjusted so that the depth $h_1$ of the ink 19 is less than the height $h_3$ of the ink column 21.

Figure 16:
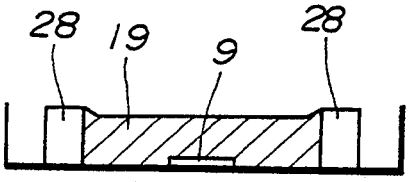

In an ink jet recording head shown in FIG. 16, maintaining walls 28 are provided at a position far from the heater element 9. The depth $h_1$ of the ink 19 on the heater element 9 is maintained at a constant depth ($h_1 < h_3$) by the meniscus generated on a solid-liquid surface between each maintaining wall 28 and the ink 19. Each maintaining wall 28 does not have a function which prevents a pressure from dispersing in a direction parallel to the surface of the ink 19. Each maintaining wall 28 is mainly used for maintaining the depth $h_1$ of the ink 19 on the heater element 9 at a constant depth.

Figure 15:
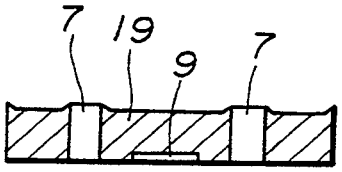
FIGS. 15, 16 and 17 are diagrams illustrating states where the surfaces of the ink are maintained.

The walls 7 shown in FIG. 15 and the maintaining walls 28 can be made of the dry film photo-resist.

Figure 17:
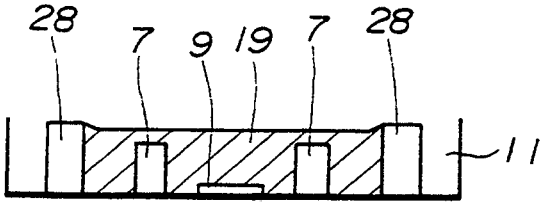
Figure 18:
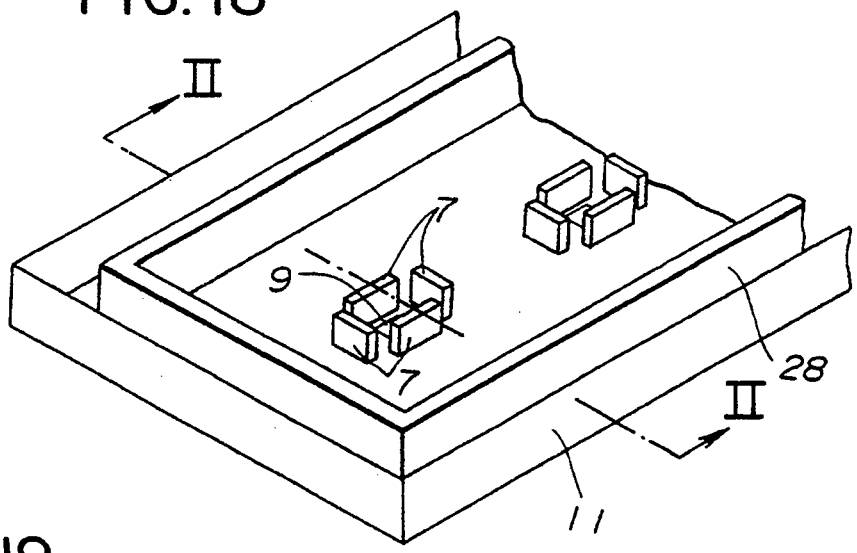
FIG. 18 is a perspective view showing the ink jet recording head according to an embodiment of the present invention.

FIG. 17 shows an ink jet recording head having the walls 7 and the maintaining walls 28. The walls 7 are provided close to the heater element 9 and put under the ink 19. The maintaining walls 28 are provided far from the heater element 9. In the ink jet recording head shown in FIG. 17, the depth $h_1$ of the ink 19 on the heater element 9 is maintained by the maintaining walls 28 and the walls 7 prevent the pressure from dispersing in a direction parallel to the surface of the ink 19. This type of the ink jet recording head is concretely shown in FIG. 18 which is a perspective view of the same. In FIG. 18, each heater element 9 is surrounded with four walls 7 at four sides thereof and the maintaining walls 28 surround the heater element 9 and the walls 7 at a position far from the heater element 9. FIG. 17 described above is a cross sectional view taken along line B—B shown in FIG. 18.

FIG.. 19 shows an ink jet recording head having a U-shaped tube 30 connecting an ink supplier 29 and the ink jet recording head. An ink in the ink supplier 29 is communicated with the ink 19 in the ink jet recording head via the U-shaped tube 30. The U-shaped tube 30 functions as means for adjusting the depth of the ink 19 on the heater element 9.

Figure 19:
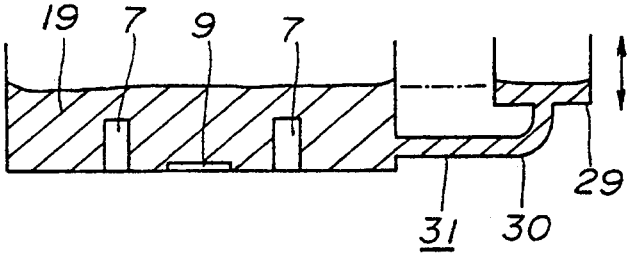
FIGS. 19 and 20 are diagrams illustrating mechanisms for supplying the ink to the ink jet recording head.

That is, a level of the surface of the ink in the ink supplier 29 and a level of the surface of the ink in the head are always equal to each other as indicated by a one dotted line in FIG. 19. Thus, the depth of the ink 19 on the heater element 9 can be adjusted by moving the ink supplier 29 upward and downward. In this ink jet recording head, the ink supplier 29 is moved upward and downward so that the depth $h_1$ of the ink 19 on the heater element 9 is less than the height $h_3$ of the ink column 21 indicated in FIG. 13. The ink supplier 29 is moved in accordance with the amount of ink consumed when an image is recorded.

Figure 20:
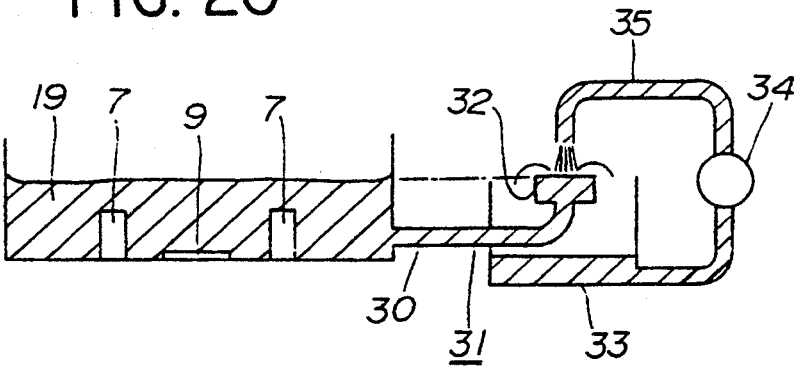

FIG. 20 shows a modification of the ink jet recording head shown in FIG. 19. In FIG. 20, the ink jet recording head has an ink supplier 32 connected to an ink chamber of the head by the U-shaped tube 31, a reservoir 33, a pump 34 and a returning tube 35. The ink overflows the ink supplier 32. A level of the surface of the ink overflowing the ink supplier 32 is equal to a level of the surface of the ink 19 on the heater element 9 of the ink jet recording head. The reservoir 33 receives the ink overflowing the ink supplier 32, and then the pump 34 pumps up the ink in the reservoir 33. The ink pumped by the pump 34 is supplied via the returning tube 35 to the ink supplier 32. In this ink jet recording head, the level at which the ink overflows the ink supplier 32 is always equal to the level of the surface of the ink 19 on the heater element 9, so that the depth of the ink 19 on the heater element 9 is maintained at a constant depth.

In the ink jet recording head shown in each of FIGS. 15 through 20, the depth $h_1$ of the ink 19 on the heater element 9 can be maintained at a constant depth so that $h_1$ is less than $h_3$ ($h_1 < h_3$).

The walls 7 have a function which prevent the pressure from dispersing in a direction parallel to the surface of the ink 19. The flying properties of the ink such as the flying speed and the flying direction, depend on the structure of each wall 7.

Figure 21A:
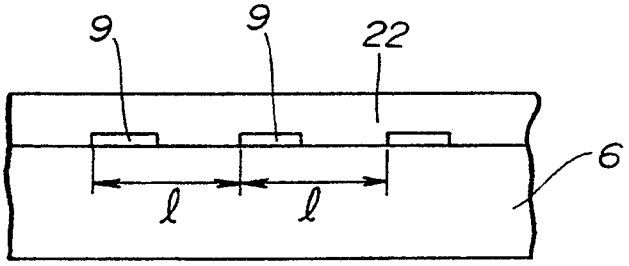
FIGS. 21*a–c* illustrate a process for forming the walls surrounding the heater element.
Figure 21B:
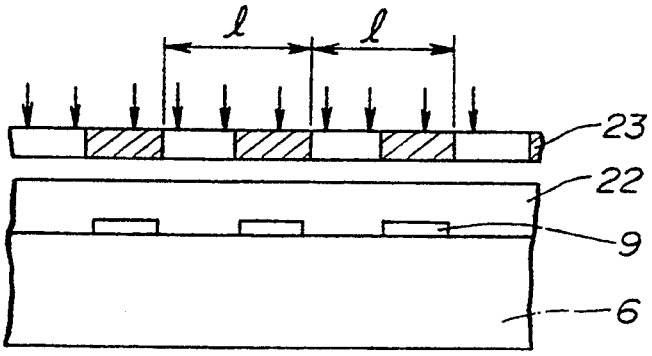
Figure 21C:
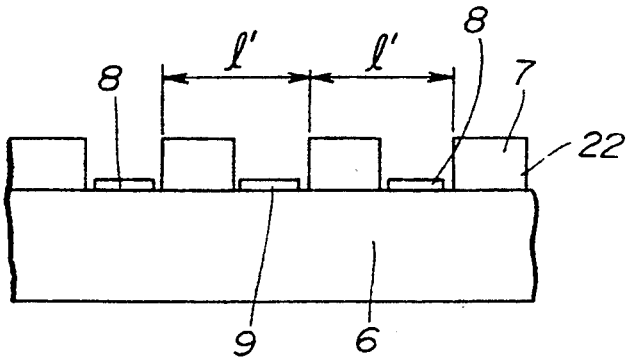
Figure 22A:
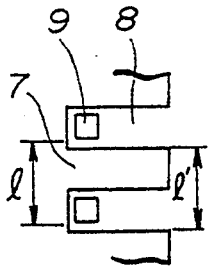
FIGS. 22*a–d* and 23*a–e* are plan views showing the structures of the walls surrounding the heater element.
Figure 22B:
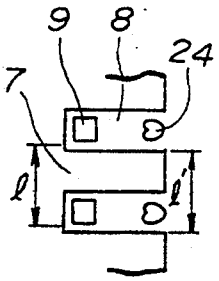
Figure 22C:
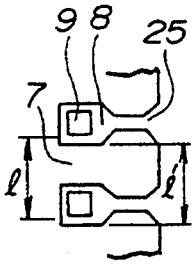
Figure 22D:
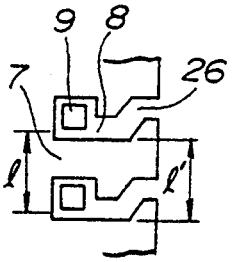

The walls 7 are formed on the hater plate 6, on which plate the heater elements 9 are arranged in a line, in accordance with processes (a) (b) and (c) shown in FIG. 21. The processes for forming the walls 7 are identical to those shown in FIG. 6. In the processes shown in FIG. 21, a pitch between the heater elements 9 adjacent to each other is 1. A pitch between mask patterns, which are provided on the photo mask 23 and correspond to the heater elements 9 adjacent to each other is also 1. Thus, a pitch (1') between the walls 7 adjacent to each other equal to the pitch (1) between the heater elements 9. That is, each heater element 9 is provided between the walls 7 adjacent to each other, as shown in FIG. 22 and FIG. 23. The structures of the ink jet recording head shown in FIG. 22 are identical to those shown in FIG. 8, and the structures of ink jet recording head shown in FIG. 23 are identical to those shown in FIG. 9.

Figure 23A:
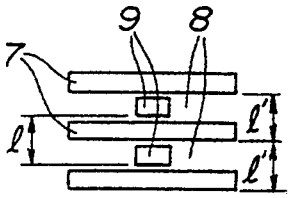
Figure 23B:
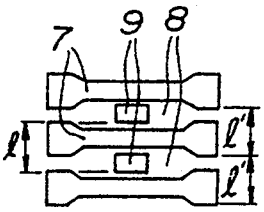
Figure 23C:
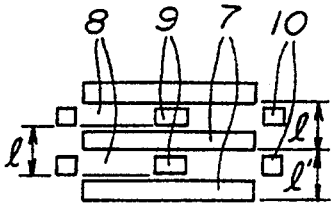
Figure 23D:
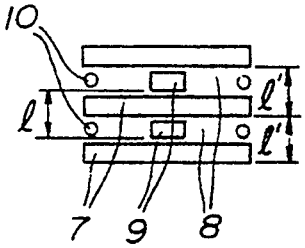
Figure 23E:
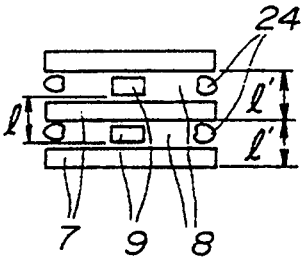
Figure 24:
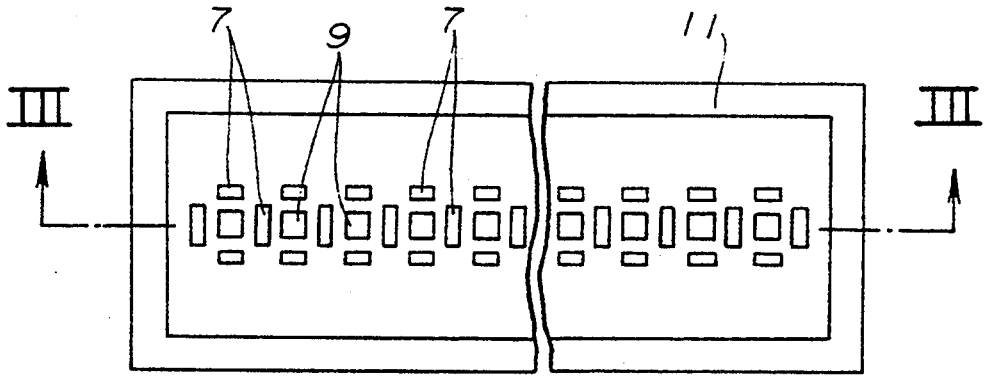
FIG. 24 is a plan view showing the ink jet recording head according to an embodiment of the present invention.
Figure 25:
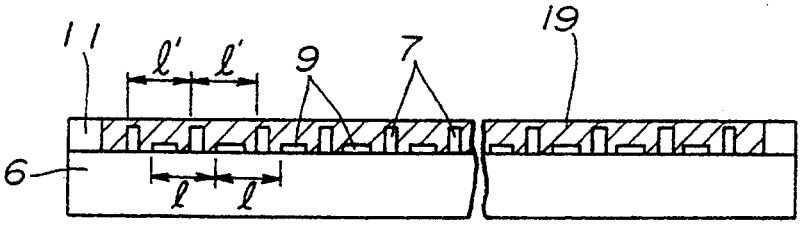
FIG. 25 is a cross sectional view taken along line A—A shown in FIG. 5.

FIGS. 24 and 25 show an example of an ink jet recording head. FIG. 25 is a cross sectional view taken along line A—A shown in FIG. 24. In FIGS.24 and 25, a plurality of the heater element 9 are arranged in a line on the heater plate 6. Four walls 7 are provided on the heater plate so as to surround each heater element 9. A pitch between the heater elements 9 is (1) and a pitch between the walls 7 arranged in the same direction the heater elements are arranged is (1'). The pitch between the heater elements 9 is equal to the pitch between the walls 7 (1=1'). The structure, regarding each heater element 9 and walls 7, shown in FIGS. 24 and 25, is substantially identical to that shown in FIG. 23 (*c*).

The ink jet recording head as shown in FIGS. 24 and 25 recorded an dot image on the recording sheet in Experiments 13 and 14.

In Experiment 13, the conditions regarding the structure of the ink jet recording head were determined as follows.

| | |
|---|---|
| SIZE OF HEATERG ELEMENT 9 | 80 μm × 80 μm |
| PITCH BETWEEN HEATER ELEMENTS 9 | 127 μm (200 dpi) |
| THE NUMBER OF HEATER ELEMENTS 9 | 30 |
| RESISTANCE OF HEATER ELEMENT 9 | 31 ohm |
| SHAPE OF THE WALL 7 | SHOWN IN FIG. 23(c) |
| SIZE OF THE WALL 7 | WIDTH 37 μm<br>LENGTH 120 μm<br>HEIGHT 35 μm |
| PITCH BETWEEN WALLS 7 | 127 μm (200 dpi) |
| INK | INK USED IN BJ130 (CANON CO. LTD) |
| RECORDING SHEET | MATTED COAT SHEET NM (MITSUBISHI SEISHI CO. LTD) |

Driving conditions of the ink jet recording head were determined as follows.

| | |
|---|---|
| DRIVING VOLTAGE | 15 V |
| CONTINUOUS DRIVING FREQUENCY | 2 kHz (SOLID PRINTING) |
| PULSE WIDTH | 5 μsec. |

In Experiment 13, a distance between the surface of the ink and the surface of the recording sheet was 1 mm.

In Experiment 14, the conditions regarding the structure of the ink jet recording head were determined as follows.

| | |
|---|---|
| SIZE OF HEATERG ELEMENT 9 | 40 μm × 40 μm |
| PITCH BETWEEN HEATER ELEMENTS 9 | 63.5 μm (400 dpi) |
| THE NUMBER OF HEATER ELEMENTS 9 | 30 |
| RESISTANCE OF HEATER ELEMENT 9 | 31 ohm |
| SHAPE OF THE WALL 7 | SHOWN IN FIG. 23(c) |
| SIZE OF THE WALL 7 | WIDTH 15 μm<br>LENGTH 60 μm<br>HEIGHT 15 μm |
| PITCH BETWEEN WALLS 7 | 63.5 μm (400 dpi) |
| INK | INK USED IN BJ130 (CANON CO. LTD) |
| RECORDING SHEET | MATTED COAT SHEET NM (MITSUBISHI SEISHI CO. LTD) |

Driving conditions of the ink jet recording head were determined as follows.

| | |
|---|---|
| DRIVING VOLTAGE | 15 V |
| CONTINUOUS DRIVING FREQUENCY | 2 kHz (SOLID PRINTING) |
| PULSE WIDTH | 3.6 μsec. |

In Experiment 14, a distance between the surface of the ink and the surface of the recording sheet was 1 mm.

Experiments for comparison with Experiments 13 and 14 were performed (Comparison examples).

In Comparison Example 1, the conditions regarding the structure of the ink jet recording head were determined as follows.

| | |
|---|---|
| PITCH BETWEEN HEATER ELEMENTS 9 | 127 μm (200 dpi) |
| PITCH BETWEEN WALLS 7 | 254 μm (100 dpi) |

Other conditions were the same as those of Experiment 13 described above.

In Comparison Example 2, the conditions regarding the structure of the ink jet recording head were determined as follows.

| | |
|---|---|
| PITCH BETWEEN HEATER ELEMENTS 9 | 127 μm (200 dpi) |
| PITCH BETWEEN WALLS 7 | 508 μm (50 dpi) |

Other conditions were the same as those of Experiment 13.

In Comparison Example 3, the conditions regarding the structure of the ink jet recording head were determined as follows.

| | |
|---|---|
| PITCH BETWEEN HEATER ELEMENTS 9 | 63.5 μm (400 dpi) |
| PITCH BETWEEN WALLS 7 | 127 μm (200 dpi) |

Other conditions were the same as those of Experiment 14 described above.

In Comparison Example 4, the conditions regarding the structure of the ink jet recording head were determined as follows.

| | |
|---|---|
| PITCH BETWEEN HEATER ELEMENT | 63.5 μm (400 dpi) |
| PITCH BETWEEN WALLS 7 | 254 μm (100 dpi) |

Other conditions were the same as those of Experiment 14.

In the ink jet recording head used in Experiments 13 and 14, one heater element 9 was provided between the walls 7 adjacent to each other. In the ink jet recording head used in Comparison examples 1 and 3, two heater elements 9 are provided between the walls 7 adjacent to each other. In the ink jet recording head used in Comparison Examples 2 and 4, four heater elements 9 were provided between the walls 7 adjacent to each other.

The results of Experiments 13 and 14 and Comparison Examples 1, 2, 3 and 4 are indicated in Table-6.

TABLE 6

| HEAD | REQUIRED DOT PITCH | DOT SHAPE | DISPERSION OF DOT PITCH | QUALITY |
|---|---|---|---|---|
| EXP. 13 | 127 μm | circle | ≦±10 μm | ∘ |
| EXP. 14 | 63.5 μm | circle | ≦±6 μm | ∘ |
| COM. 1 | 127 μm | oval | ≧±40 μm | x |
| COM. 2 | 127 μm | mist | impossible to measure | x |
| COM. 3 | 63.5 μm | oval | ≧±30 um | x |
| COM. 4 | 63.5 μm | mist | impossible to measure | x |

According to the results shown in Table-6, in Experiments 13 and 14, a dispersion of a pitch between the adjacent dots formed on the recording sheet was small (≦±10 μm, ≦±6 μm) and an image having high quality was formed on the recording sheet. However, in Comparison Example 1, the dispersion of the pitch of adjacent dots formed on the recording sheet was large (≧+40 μm) and the quality of an image formed on the recording sheet was deteriorated. In addition, in Comparison Examples 2, 3 and 4, the ink mist was dispersed from the ink jet recording head and the quality of an image formed on the recording sheet greatly deteriorated.

Figure 26:
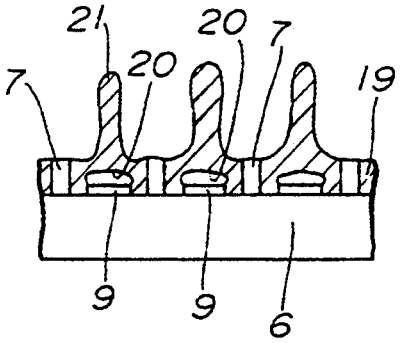
FIG. 26 is a diagram illustrating the ink column projecting from the surface of the ink.
Figure 49:
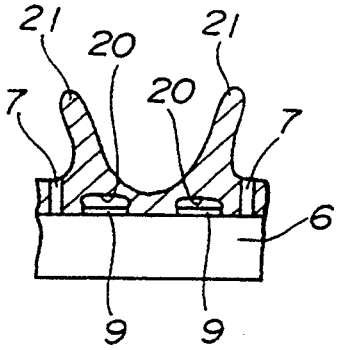
FIGS. 49 and 50 are diagrams illustrating inferior conditions of the ink columns projecting from the surface of the ink.
Figure 50A:
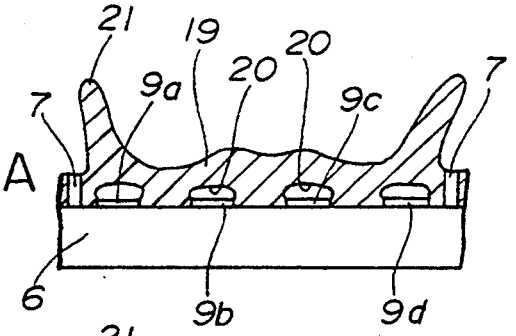
Figure 50B:
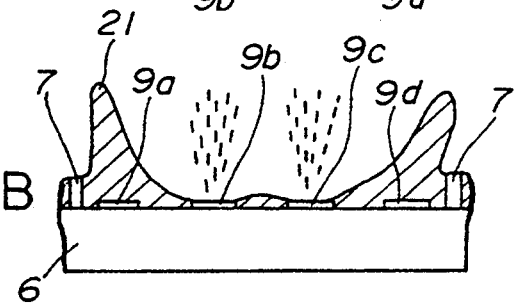

In each of ink jet recording heads used in Experiment 13 and Comparison Examples 1 and 2, when all the heater elements 9 were driven by the driving pulse signal at the same time, the ink in each ink jet recording head was observed by use of the stroboscope operating in synchronism with the driving pulse. The vehicle comprising matter with the same properties as the ink for BJ130 manufactured by CANON CO. LTD was substituted for the ink for BJ130. In the case of Experiment 13, the ink columns 21 such as those shown in FIG. 26 were obtained. That is, the ink column 21 corresponding to each heater element 9 grew at a predetermined speed in a direction substantially perpendicular to the surface of the heater plate 6. In the cases of Comparison Examples 1 and 2, the ink columns 21 such as those shown in FIGS. 49 and 50 are obtained. That is, the ink columns 21 grew at positions close to the walls 7 in a direction greatly differing from a direction perpendicular to the surface of the heater plate 6.

Especially, in the case of Comparison Example 2, a pressure in the ink 19 based on the bubbles 20 generated on the heater elements 9b and 9c placed between the heater elements 9a and 9d close to the walls 7 was dispersed. Thus, the surface of the ink 19 on the heater elements 9b and 9c only rose and no ink columns 21 were generated on the heater elements 9b and 9c, as shown in FIG. 50 (*a*). In addition, there was no wall 7 between the heater elements 9a and 9d so that a big wave was generated between the heater elements 9a and 9d when the ink columns 21 grow and fly. Thus, the level of the surface of the ink on the heater elements 9b and 9c was greatly changed due to the big wave generated between the walls 7. When the heater elements 9a and 9b were driven in a state where the surface of the ink on the heater elements 9b and 9c fell, the ink on the heater elements 9b and 9c was boiled instantly so that the ink mist was dispersed, as shown in FIG. 50 (*b*).

In the ink jet recording head used in Experiment 13, a pitch between the heater elements 9 adjacent to each other is equal to a pitch between the walls 7 adjacent to each other, so that a positional relationship between each heater element 9 and the walls 7 surrounding each heater element 9 is identical to another such positional relationship one. For example, a distance between each heater element 9 and its corresponding wall 7 is constant. Thus, a characteristic of the flying ink corresponding to each heater element 9 can be constant.

Figure 27A:
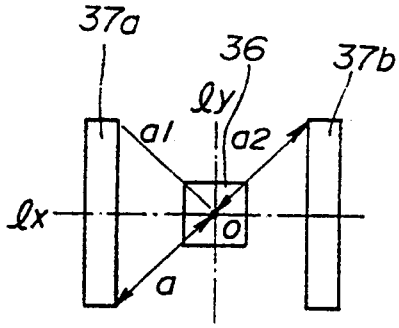
FIGS. 27*a–c*, 28*a–d*, 30, 31 and 32 are plan views showing the structures of the walls surrounding the heater element.
Figure 27B:
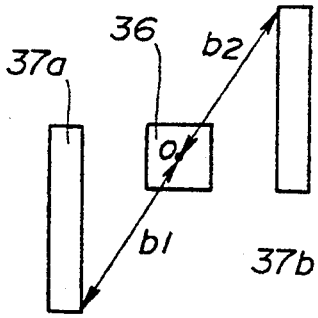
Figure 27C:
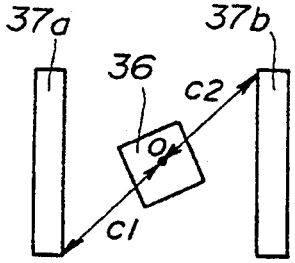
Figure 28A:
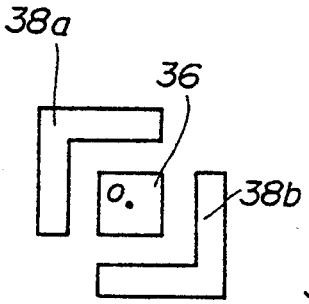
Figure 28B:
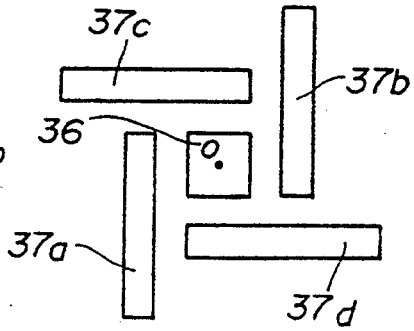
Figure 28C:
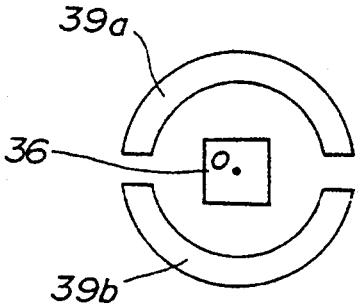
Figure 28D:
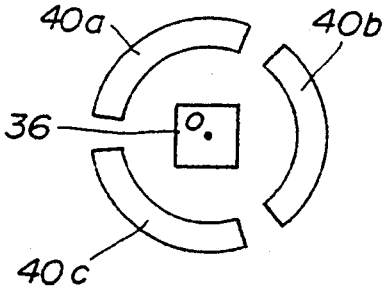

FIGS. 27 and 28 show other structures of the walls surrounding an energy operation portion 36 such as the heater element.

In FIG. 27, (*a*), (*b*) and (*c*) are respectively schematic plan views showing the energy operation portion 36 and the walls. In (a), (b) and (c) respectively of FIG. 27, two walls 37a and 37b are provided around the energy operation portion 36. The shape and the size of the wall 37a are respectively identical to those of the wall 37b. The walls 37a and 37b are symmetrically arranged with respect to a center O of the energy operation portion 36. That is, in FIG. 27 (*a*), a distance ($a_1$) between an end of the wall 37a and the center O of the energy operation portion 36 is equal to a distance ($a_2$) between a corresponding end of the wall 37b and the center O of the energy operation portion 36 ($a_1=a_2$). In the cases shown in FIG. 27 (*b*) and (*c*), $b_1$ is equal to $b_2$ ($b_1=b_2$) and $c_1$ is equal to $c_2$ ($C_1=c_2$) in the same manner as the case shown in FIG. 27 (*a*). Especially, in FIG. 27 (*a*), the walls 37a and 37b are also symmetrically arranged with respect to a line $1_x$ and a line $1_y$ perpendicular to the line $1_x$. The line $1_x$ passes through the center O of the energy operation portion 36 and is parallel to a line in which the energy operation portion 36 and the walls 37a and 37b are arranged. That is, a distance ($a_1'$) between another end of the wall 37a and the center O of the energy operation portion 36 is equal to the above distances ($a_1$) and ($a_2$).

In the ink jet recording head shown in (a), (b) and (c) of FIG. 27, respectively, the wall 37a has a shape and a size identical to that of the wall 37b, and those walls are symmetrically arranged with respect to the center O of the energy operation portion so that distances between the center O of the energy operation portion 36 and the walls 37a and 37b are equal to each other.

In FIG. 28, each of (a), (b). (c) and (d) is also a schematic plan view showing the energy operation portion 36 and the walls. In FIG. 28 (*a*), two L-shaped walls 38a and 38b surround the energy operation portion 36 and are symmetrically arranged with respect to the center O of the energy operation portion 36. In FIG. 28 (*b*), four walls 37a, 37b, 37c and 37d, which have the same shape and the same size, surround the energy operation portion 36. The walls 37a and 37b are symmetrically arranged with respect to the center O of the energy operation portion 36. The walls 37c and 37d are also symmetrically arranged with respect to the center O of the energy operation portion 36. In FIG. 28 (*c*), two half circular arc shaped walls 39a and 39b surround the energy operation portion 36 and are symmetrically arranged with respect to the center O of the energy operation portion 36. In FIG. 28 (*d*), three circular arc shaped walls 40a, 40b and 40c surround the energy operation portion 36 and are symmetrically arranged with respect to the center O of the energy operation portion 36.

Also, in the ink jet recording head shown in each of (a), (b), (c) and (d) of FIG. 28, a plurality of the walls which has the same shape and the same size are symmetrically arranged with respect to the center O of the energy operation portion 36 so that distances between the center O of the energy operation portion 36 and the walls are equal to each other.

In the embodiments shown in FIGS. 27 and 28, a plurality of the walls which have the same shape and the same size are symmetrically arranged with respect to the center of the energy operation portion 36, so that the pressure in the ink can be equally prevented from dispersing in all directions. Thus, the ink can fly from the ink jet recording head in a stabilized state.

Figure 29:
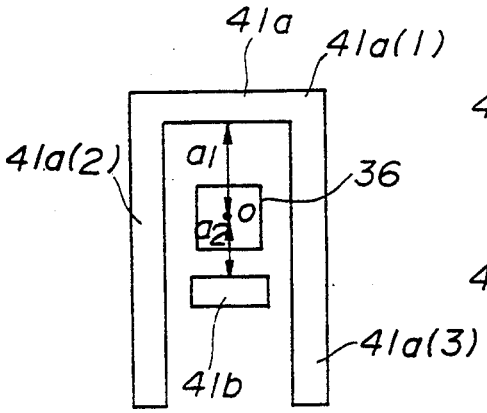
Figure 30:
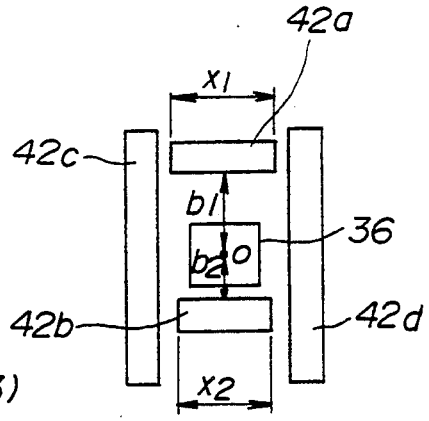

FIG. 29 and FIG. 30 which are schematic plan views also show examples of structure of the walls surrounding an energy operation portion 36.

In FIGS. 29, two walls 41a and 41b whose shapes differ from each other surround the energy operation portion 36 such as the heater element. The wall 41a has wall elements 41a(1), 41a(2) and 41a(3). The wall element 41a(2) projects from an end of the wall element 41a(1) and the wall element 41a(3) projects from another end of the wall element 41a(1) so that the wall elements 41a(2) and 42a(3) are parallel to each other. Thus, the wall elements 41a(1), 41a(2) and 41a(3) form a three-sided wall 41a. The wall 41b which is shorter than the wall element 41a(1) is provided at an open side of the wall 41a. It is easy for the pressure in the ink to be dispersed in a direction from the energy operation portion 36 toward the wall 41b since there is a space between the wall 41b and each of the wall elements 41a(2) and 41a(3). Thus, the walls 41a and 41b are arranged so that the wall 41b is closer to the energy operation portion than the wall element 41a(1). That is, a distance ($a_2$) between the wall 41b and the center O of the energy operation portion 36 is less than a distance ($a_1$) between the wall element 41a(1) and the center O of the energy operation portion 36 ($a_1>2$). As a result, the pressure in the ink is prevented from dispersing in both the direction toward the wall 41b and that toward the wall element 41a(1). Thus, the ink can fly from the ink jet recording head in a stabilized state.

In FIG. 30, four walls 42a, 42b, 42c and 42d surround the energy operation portion 36. The walls 42c and 42d have the same shape and the same size, and a distance between the wall 42c and the center O of the energy operation portion 36 is equal to a distance between the wall 42d and the center O thereof. In addition, the walls 42c and 42d are wider than the walls 42a and 42b. The wall 42a is wider than the wall 42b. That is, the width $x_1$ of the wall 42a is greater than the width $x_2$ of the wall 42b. The walls 42a and 42b are arranged between the walls 42c and 42d so that the wall 42b is closer to the energy operation portion 36 than the wall 42*a*. That is, a distance $b_2$ between the wall 42*b* and the center O of the energy operation portion 36 is less than a distance $b_1$ between the wall 42*a* and the center O thereof ($b_1 > b_2$). As a result, the pressure in the ink can be prevented from dispersing in both the direction toward the wall 42*a* and that toward the wall 42*b*. Thus, the ink can fly from the ink jet recording head in a stabilized state.

Figure 51A:
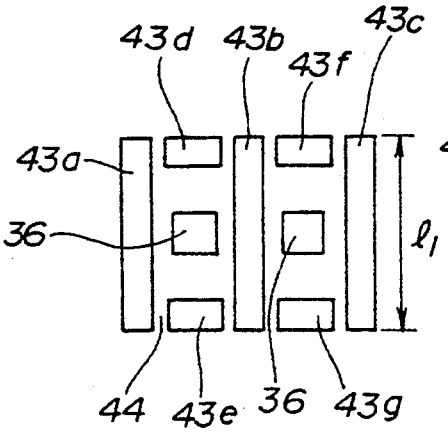
FIGS. 51*a–b*, 52, 53 and 54 are plan views showing the heater element and the walls surrounding the heater element.
Figure 51B:
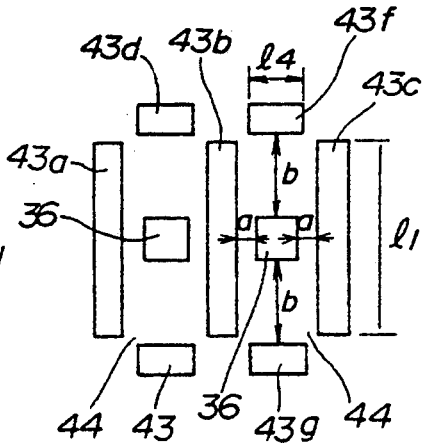

In the ink jet recording head in which there is no nozzle, it is desirable that a large wall be provided between the heater elements (energy operation portions) adjacent to each other, as shown in FIG. 51 (*a*) and FIG. 51 (*b*). Especially, in the case shown in FIG. 51 (*b*), each space 44 between the walls adjacent to each other (for example, the walls 43*a* and 43*e* are adjacent to each other) is large so that it is easy to supply the ink toward the heater element 36.

However, in the case shown in FIG. 51 (*b*), a distance (b) between the heater element 36 and each of the walls 43*g* and 43*f* which are arranged in a direction perpendicular to a line in which the heater elements 36 are arranged greatly differs from a distance (a) between the heater element 36 and each of the walls 43*b* and 43*c* which are provided between the heater elements 36 adjacent to each other. Thus, it is difficult for the ink to fly in a stabilized state.

Figure 31:
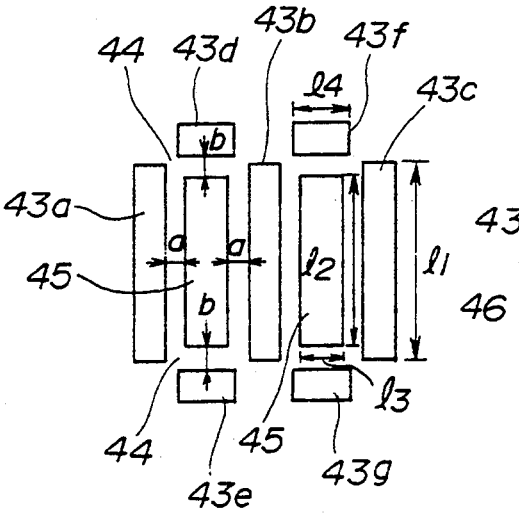

FIG. 31 shows the structure of the heater element and the walls in which the disadvantages described above are eliminated.

FIG. 31 is a schematic plan view showing the heater elements and the walls. In FIG. 31, each heater element 45 is surrounded by four walls. The length $l_2$ of the heater element 45 in a direction perpendicular to a line in which the heater elements are arranged is larger than the length $l_3$ thereof in a direction parallel to the above line. The length $l_1$ of each wall (43*b*) provided between the heater elements 45 adjacent to each other is slightly greater than the length $l_2$ of a longer side of the heater element 45. The length $l_4$ of each of the walls arranged in a direction perpendicular to the line in which the heater elements are arranged is also slightly greater than the length $l_3$ of the shorter side of a heater element 45. A distance (a) between the heater element 45 and each wall provided between the heater elements adjacent to each other is substantially equal to a distance (b) between the heater element 45 and each of the walls arranged in a direction perpendicular to the line in which the heater elements are arranged.

In Experiment 15, the ink flew under the following conditions.

| | |
|---|---|
| LENGTH OF HEATER ELEMENT $l_2$ | 110 μm |
| LENGTH OF HEATER ELEMENT $l_3$ | 30 μm |
| LENGTH OF WALL BETWEEN HEATER ELEMENTS $l_1$ | 130 μm |
| LENGTH OF WALL (SMALL) | 34 μm |
| PITCH BETWEEN HEATER ELEMENTS | 63.5 μm (400 dpi) |
| RESISTANCE OF HEATER ELEMENT | 120 ohm |
| INK | VIECLE EQUAL TO INK USED IN BJ130 (CANON CO. LTD) |
| RECORDING SHHET | MATTED COAT SHEET NM (MITSUBISHI SEISHI CO. LTD) |
| DRIVING VOLTAGE | 26 v |
| DRIVING FREQUENCY | 2 kHz |
| WIDTH OF DRIVING PULSE | 7.2 μsec. |

In Comparison example 5, the ink jet recording head had a structure shown in FIG. 51 (*b*), and the size of each heater element 36 was 30 μm× 30 μm. Other conditions such, as the size ($l_1$ and $l_4$) of the walls, were identical to those of Experiment 15. In addition, in Comparison example 5, the driving voltage was 15 v, and the driving frequency and the width of the driving pulse were respectively equal to those of Experiment 15. In Comparison example 5, the ink flew from the ink jet recording head under the above conditions.

In Comparison example 5, when the ink dots formed on the recording sheet were observed, a dispersion value regarding the diameter of the ink dot was "191" and a dispersion value regarding the position of the ink dot was "160". The dispersion value was defined as the number of ink dots whose diameter or positions were dispersed from a mean value thereof equal to or greater than ±10% thereof. The mist shaped ink dots were formed on the recording sheet and there were ink dots missing from the recording sheet so that the dot image having inferior quality was formed on the recording sheet.

On the other hand, in Experiment 15, the dispersion values regarding both the diameter of the ink dot and the position thereof were respectively very small so that the dot image having good quality was formed on the recording sheet.

In the case of Experiment 15, distances between the heater element and walls surrounding the heater element were substantially equal to each other so that the ink can fly in a stabilized state without dispersing like a mist. In addition, a space 44 between the walls adjacent to each other was sufficient to supply the ink toward the heater element 45 so that it was possible for the ink to fly at a high frequency.

Figure 32:
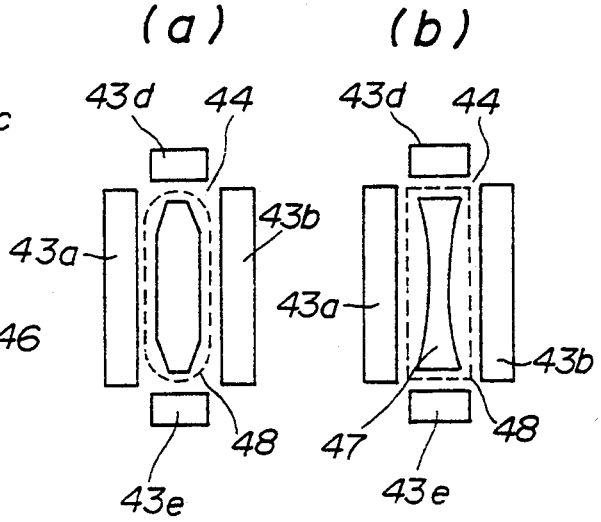

The shape of each heater element 45 is not limited to that shown in FIG. 31, as it is also possible to use heater elements as shown in FIG. 32 (*a*) and (*b*). In FIG. 32 (*a*), each corner of the heater element 45 is beveled. In FIG. 32 (*b*), the each longer side of the heater element 45 is curved. In each of cases shown in FIG. 32 (*a*) and (*b*), the bubble is formed in the ink on the heater element 45 as indicated by a dotted line.

Figure 52:
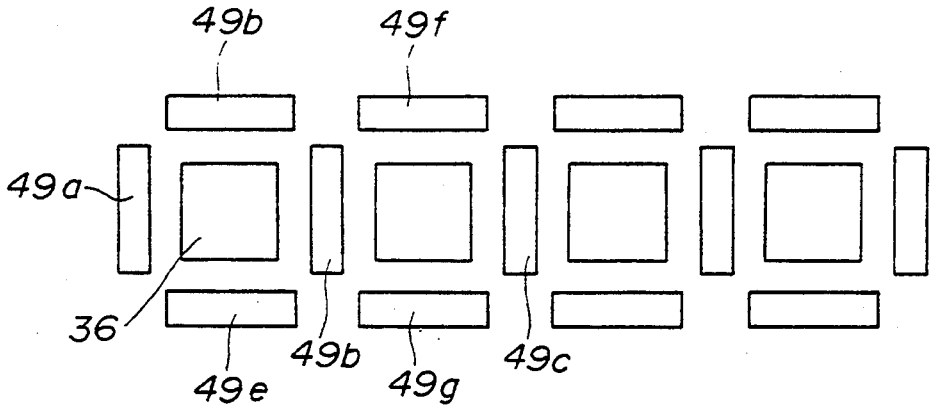
Figure 53:
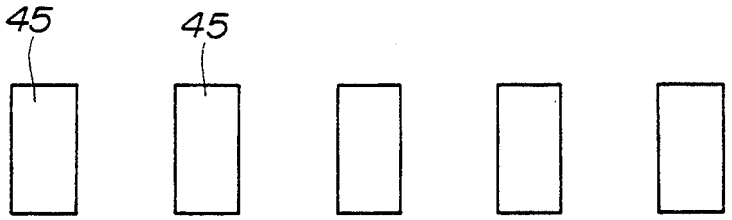
Figure 54:
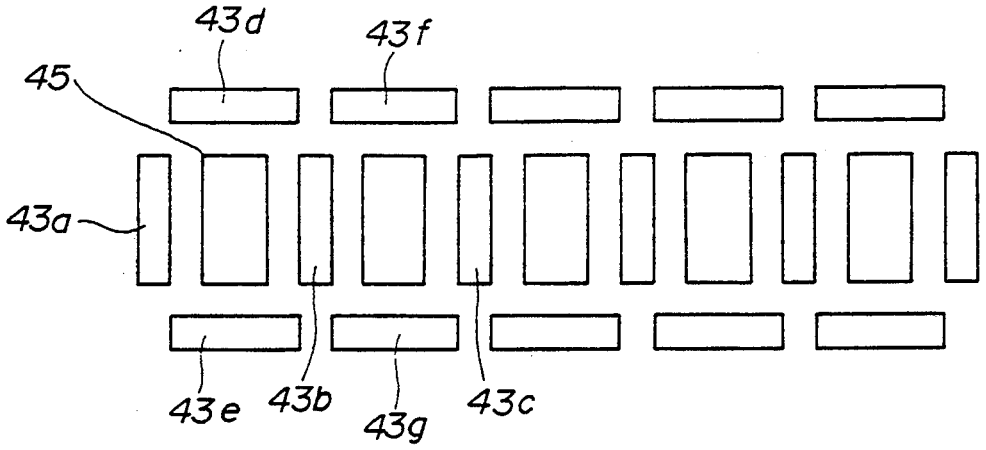

When each heater element has a square shape, heater elements 36 and the walls are arranged as shown in FIG. 52. In FIG. 52, the shapes and the sizes of walls 49*a*, 49*b*, 49*c* and 49*d* are identical to each other. Distances between the heater element 36 and walls 49*a* through 49*d* are also equal to each other. When a heater element 45 having rectangular shape as shown in FIG. 53 is substituted for each heater element 36 shown in FIG. 52, the ink jet recording head as shown in FIG. 54 is obtained. In the ink jet recording head shown in FIG. 54, the length of each of walls 43*d* and 43*e* opposite to the shorter sides of the heater element 45 is equal to the length of each of walls 43*a* and 43*b* opposite to longer sides of the heater element 45. But, when the bubble grows in the ink on each heater element 45, the pressure transmitted in the ink from the shorter sides of the heater element 45 toward a corresponding wall 43*d* or 43*e* is smaller than the pressure transmitted in the ink from the longer sides of the heater element 45 to a corresponding wall 43*a* or 43*b*. Thus, the effect of preventing the pressure from dispersing in the ink from shorter side of the heater element 45 toward the corresponding the wall 43*d* or 43*e* is greater than the effect of preventing the pressure from dispersing in the ink from the longer side of the heater element 45 toward the corresponding wall 43*a* of 43*b*. As a result, it is difficult for the ink to fly in a stabilized state.

Figure 33:
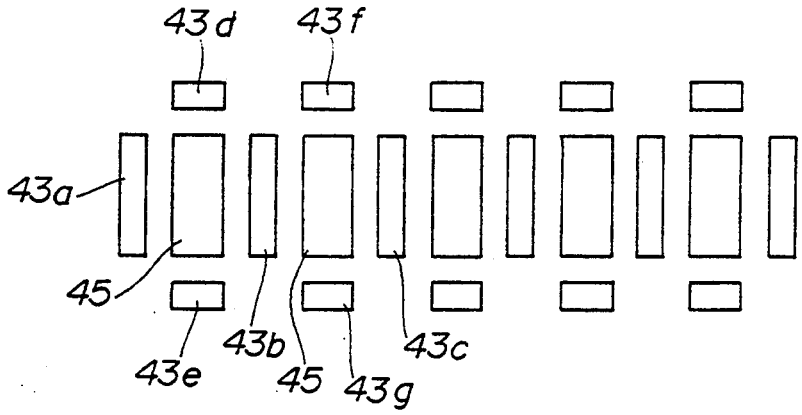
FIG. 33 is a plan view showing the ink jet recording head in which a plurality of heater elements are arranged in a line and the walls surround each of the heater elements.

The structure of the arrangement of the heater elements and the walls in which the disadvantage described above is eliminated is shown in FIG. 33. In FIG. 33, the length of each of walls 43*d* and 43*e* opposite to the shorter sides of the heater element 45 is less than the length of each of walls 43*a* and 43*b* opposite to the longer sides of the heater element 35. Thus, the effect for preventing the pressure from dispersing in the ink from the shorter side of the heater element 45 toward the corresponding wall 43*d* or 43*e* becomes equal to the effect for preventing the pressure from dispersing in the ink from the longer side of the heater element 45 toward the corresponding wall 43*a* or 43*b*. As a result, it is possible for the ink to fly in a stabilized state.

It is generally desirable that the walls surrounding the heater element are higher as possible since the pressure in the ink can be effectively prevented from dispersing. For example, the height of each wall is determined in a range between 10 μm and 100 μm. The thickness of each wall in a direction parallel to the surface of the heater element on which each wall is provided can not be too large since a density of heater elements arranged in a line on the heater plate is decreased. The thickness of each wall can not be also too small since the strength of the wall is decreased.

Figure 34:
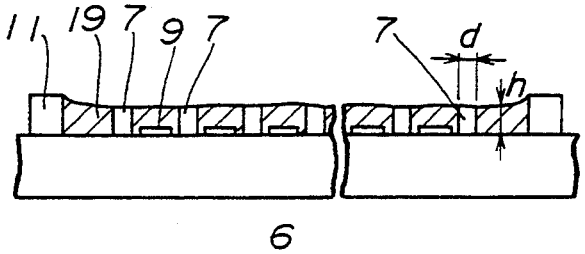
FIG. 34 is a diagram illustrating a relationship between the depth of the ink and the width of the wall.

An dot image was experimentally formed on the recording sheet by use of the ink jet recording head as shown in FIG. 25 while the height (h) and the thickness (d) of each wall 7 shown in FIG. 34 were changed into various values. The depth of the ink 19 was substantially equal to the height (h) of each wall 7.

In Experiment 16, the dot image was formed on the recording sheet under the following conditions.

| | |
|---|---|
| SIZE OF HEATER ELEMENT 9 | 65 μm × 65 μm |
| DENSITY OF HEATER ELEMENTS 9 | 180 dpi |
| THE NUMBER OF HEATER ELEMENTS 9 | 64 |
| RESISTANCE OF HEATER ELEMENT 9 | 31 ohm |
| THICKNESS (d) OF WALL 7 | 65 μm, 50 μm, 30 μm, 20 μm, 15 μm, and 10 μm |
| HEIGHT (h) OF WALL 7 | 30 μm |
| DRIVING VOLTAGE | 15 v |
| WIDTH OF DRIVING PULSE | 5 μsec. |
| CONTINUOUS DRIVING FREQUENCY | 4 kHz |
| INK | INK USED IN BJ130 (CANON CO. LTD) |

In Experiment 17, the dot image was formed on the recording sheet under the following conditions.

| | |
|---|---|
| SIZE OF HEATER ELEMENT 9 | 110 μm × 110 μm |
| DENSITY OF HEATER ELEMENTS 9 | 96 dpi |
| THE NUMBER OF HEATER ELEMENTS 9 | 30 |
| RESISTANCE OF HEATER ELEMENT 9 | 65 ohm |
| THICKNESS (d) OF WALL 7 | 80 μm, 65 μm, 50 μm, 30 μm, and 20 μm |
| HEIGHT (h) OF WALL 7 | 50 μm |
| DRIVING VOLTAGE | 25 v |
| WIDTH OF DRIVING PULSE | 6 μsec. |
| CONTINUOUS DRIVING FREQUENCY | 1.25 kHz |
| INK | INK USED IN BJ130 (CANON CO. LTD) |

In Comparison example 6, the dot image was formed on the recording sheet under the following conditions.

| | |
|---|---|
| THICKNESS (d) OF WALL 7 | 8 μm |
| HEIGHT (h) OF WALL 7 | 30 μm |

Other conditions are identical to those of Experiment 16.

In Comparison example 7, the dot image was formed on the recording sheet under the following conditions.

| | |
|---|---|
| THICKNESS (d) OF WALL 7 | 15 μm |
| HEIGHT (h) OF WALL 7 | 50 μm |

Other conditions are identical to those of Experiment 17.

In all cases, the recording sheet was the matted coat sheet NM (manufactured by MITSUBISHI SEISHI CO. LTD). A distance between the surface of the ink 19 and the surface of the recording sheet was 1 mm. When all heater elements 9 are driven at the same time, the dot image was formed on the recording sheet. The result in Experiments 16 and 17 and Comparison examples 6 and 7 are indicated in Table-7.

TABLE 7

| | HEIGHT(h) (μm) | THICKNESS(d) (μm) | d/h | IMAGE QUALITY |
|---|---|---|---|---|
| EXP. 16 | 30 | 65 | 2.17 | very fine |
| | | 50 | 1.67 | very fine |
| | | 30 | 1.00 | very fine |
| | | 20 | 0.67 | very fine |
| | | 15 | 0.50 | fine |

TABLE 7-continued

| | HEIGHT(h) (μm) | THICKNESS(d) (μm) | d/h | IMAGE QUALITY |
|---|---|---|---|---|
| | | 10 | 0.33 | fine |
| EXP. 17 | 50 | 80 | 1.60 | very fine |
| | | 65 | 1.30 | very fine |
| | | 50 | 1.00 | very fine |
| | | 30 | 0.60 | very fine |
| | | 20 | 0.40 | fine |
| COMP. 6 | 30 | 8 | 0.27 | inferior large dispersion |
| COMP. 7 | 50 | 15 | 0.30 | inferior large dispersion |

According to Table-7, when the ratio (d/h) of the thickness (d) of the wall 7 and the height (h) thereof is equal to or greater than $\frac{1}{3}$ ($d/h \geqq \frac{1}{3}$), the fine dot image is obtained. When the ratio (d/h) is less than $\frac{1}{3}$ ($d/h < \frac{1}{3}$), the dispersion of the dots becomes large so that the quality of the dot image formed on the recording sheet is deteriorated.

In each of cases of Experiment 16 where the thickness (d) of the wall was 15 μm and Comparison example 5 where the thickness (d) of the wall was 8 μm, the state in which the ink flew was observed by use of the stroboscope driven in synchronism with the driving pulse signal for the heater elements 9. In these cases, all heater elements 9 were driven at the same time.

Figure 35:
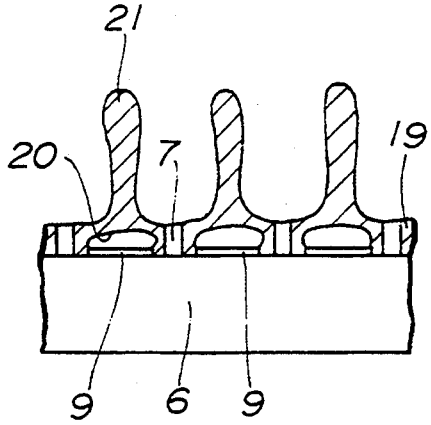
FIG. 35 is a diagram illustrating columns projecting from the surface of the ink.
Figure 36A:
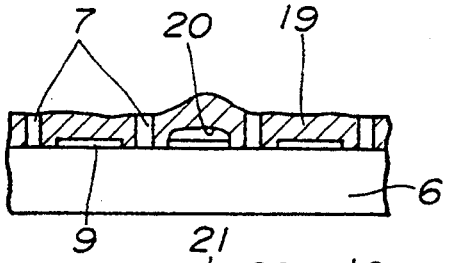
FIG. 36*a–d* illustrate a process for generating the ink drop.
Figure 36B:
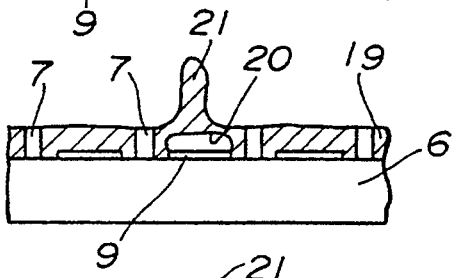
Figure 36C:
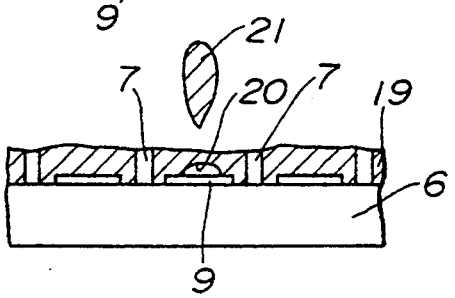
Figure 36D:
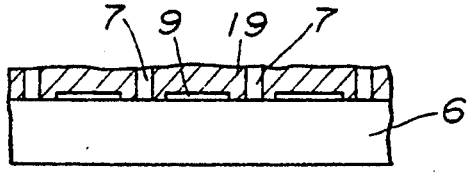
Figure 55:
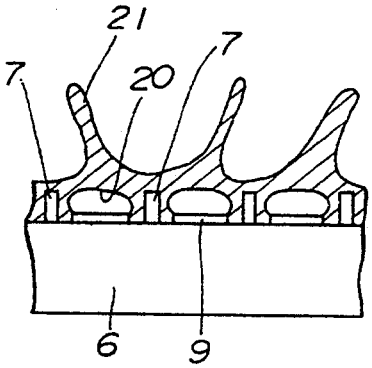
FIG. 55 is a diagram illustrating the inferior conditions of the columns projecting from the surface of the ink.
Figure 56A:
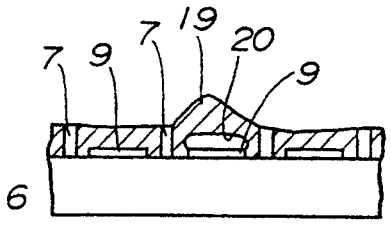
FIGS. 56*a–d* illustrate a process for generating the ink drop.
Figure 56B:
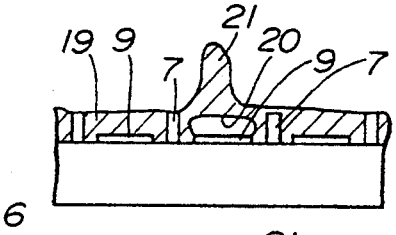
Figure 56C:
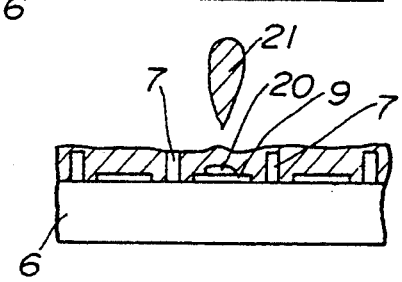
Figure 56D:
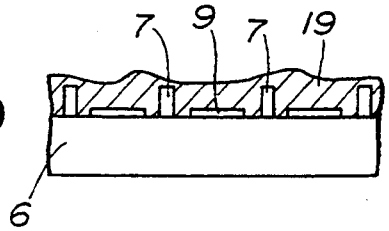

In the case of Experiment 16, the ink flew as shown in FIG. 35. That is, all ink columns 21 over the heater elements 9 grew in a direction substantially perpendicular to the surface of the heater plate 6. As a result, the fine dot image was formed on the recording sheet. On the other hand, in the case of Comparison example 6, the ink flew as shown in FIG. 55. That is, each ink column 21 was inclined from a direction perpendicular to the surface of the heater plate 6. As a result, the dispersion of the dots on the dot image formed on the recording sheet became large so that the quality of the dot image was deteriorated.

In addition, in the case of Experiment 16, when the ink columns 21 grew, the top surface of each wall 7 was exposed so that the ink column 21 independently grew over each heater element 9. However, in the case of Comparison example 6, when the ink columns 21 grew, the top surface of each wall 7 was put under the ink 19 so that the ink column did not independently grow over each heater element 9.

When only one heater element 9 was driven in the case of Experiment 16, the ink drop filed in accordance with processes shown in FIG. 36 (*a*) (*b*) (*c*) and (*d*) in this sequence. That is, (a) The bubble 20 was generated in the ink on the heater element 9 and the surface of the ink on the heater element 9 rose;

(b) The size of the bubble 20 became maximum, the ink column 21 grew and then the surface of the ink 19 fell;

(c) The bubble 20 was contracted and the ink column 21 was separated from the surface of the ink 19. Then the ink column 21 (drop) flew; and (d) Finally the state of the surface of the ink returned to the original state.

The thickness (d) of the wall 7 was sufficiently large so that the wave generated in the ink 19 was damped on the wall 7. Thus, each ink column 21 independently grew over the heater element 9.

On the other hand, when only one heater element 9 was driven in the case of Comparison example 6, the ink drop flew in accordance with processes shown in FIG. 56 (*a*) (*b*) (*c*) and (*d*) in this sequence. In this case, the width of the wall 7 was too small in comparison with the depth of the ink 19 so that the wave generated in the ink was damped a little. Thus, the growths of the ink columns 21 over the heater elements 9 were interacted each other.

In a case where the walls 7 were formed of the dry film photo-resist in the ink jet recording head as shown in FIG. 25, when the height (h) of each wall was 30 um and the thickness (d) thereof was 6 μm (Comparison example 6), some of the walls 7 were removed by the developing solution. But, when the height (h) was 30 μm and the thickness (d) was equal to or greater than 10 μm, all walls were securely formed on the heater plate 6. In addition, when the height (h) of each wall was 50 μm and the thickness (d) thereof was 15 μm (Comparison example 7), some of the walls were removed by the developing solution. But, when the height (h) was 50 μm and the thickness (d) was equal to or greater than 20 μm, all walls were securely formed on the heater plate 6.

The walls surrounding each heater element are formed so that the pressure in the ink on each heater element is prevented from dispersing. Thus, it is desirable that the size of each wall is large. However, a space between the walls adjacent each other must be sufficient to supply the ink to each heater element 9. In addition, if the space between the walls adjacent each other is too small, it is difficult to form the walls separated from each other.

Figure 37:
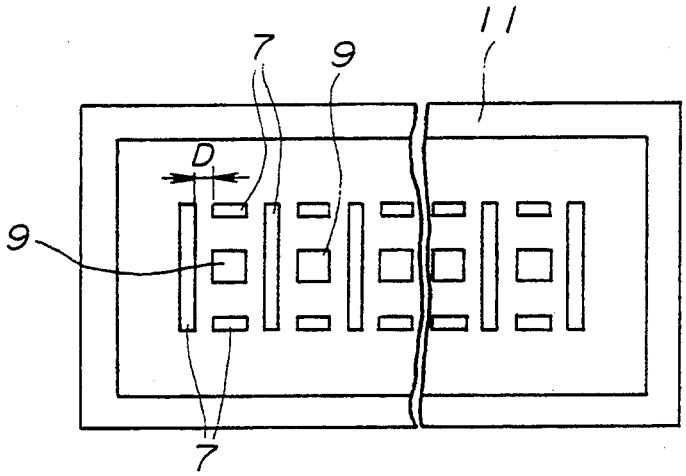
FIG. 37 is a diagram illustrating a space (D) between the walls adjacent to each other.
Figure 38:
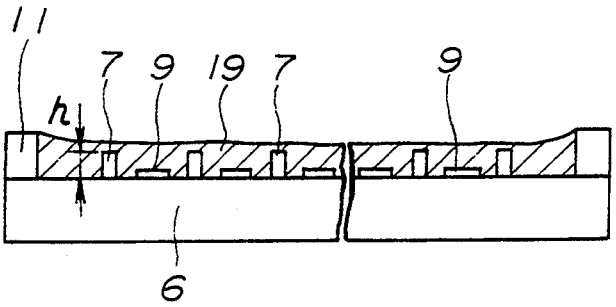
FIG. 38 is a diagram illustrating a height of the wall.

The dot image was experimentally formed on the recording sheet by use of the ink jet recording head as shown in FIG. 37 and 38 while the height (h) of each wall 7 shown in FIG. 34 and the space (D) between the walls 7 adjacent to each other as shown in FIG. 37 were changed into various values.

In Experiment 18, the dot image was formed on the recording sheet under the following conditions.

| | |
|---|---|
| SIZE OF HEATER ELEMENT 9 | 65 μm × 65 μm |
| DENSITY OF HEATER ELEMENTS 9 | 180 dpi |
| THE NUMBER OF HEATER ELEMENTS 9 | 64 |
| RESISTANCE OF HEATER ELEMENT 9 | 31 ohm |
| SPACE (D) BETWEEN WALLS 7 | 8 μm, 10 μm, 15 μm, 20 μm, 30 μm and 50 μm |
| HEIGHT (h) OF WALL 7 | 30 μm |
| DRIVING VOLTAGE | 15 v |
| WIDTH OF DRIVING PULSE | 5 μsec. |
| CONTINUOUS DRIVING FREQUENCY | 4 kHz |

-continued

| | |
|---|---|
| INK | INK USED IN BJ130 (CANON CO. LTD) |

In Experiment 19, the dot image was formed on the recording sheet under the following conditions.

| | |
|---|---|
| SIZE OF HEATER ELEMENT 9 | 110 μm × 110 μm |
| DENSITY OF HEATER ELEMENTS 9 | 96 dpi |
| THE NUMBER OF HEATER ELEMENTS 9 | 30 |
| RESISTANCE OF HEATER ELEMENT 9 | 65 ohm |
| SPACE (D) BETWEEN WALLS 7 | 10 μm, 15 μm, 20 μm, 30 μm, 50 μm and 65 μm |
| HEIGHT (h) OF WALL 7 | 50 μm |
| DRIVING VOLTAGE | 25 v |
| WIDTH OF DRIVING PULSE | 6 μsec. |
| CONTINUOUS DRIVING FREQUENCY | 1.25 kHz |
| INK | INK USED IN BJI30 (CANON CO. LTD) |

In all cases, the recording sheet was the matted coat sheet NM (manufactured by MITSUBISHI SEISHI CO. LTD). A distance between the surface of the ink 19 and the surface of the recording sheet was 1 mm. When all heater elements 9 are driven at the same time, the dot image was formed on the recording sheet. The result in Experiments 18 and 19 and are indicated in Table-8.

TABLE 8

| | HEIGHT(h) (μm) | SPACE(D) (μm) | D/h | IMAGE QUALITY |
|---|---|---|---|---|
| EXP. 18 | 30 | 8 | 0.27 | dispersed mist |
| | | 10 | 0.33 | fine |
| | | 15 | 0.50 | very fine |
| | | 20 | 0.67 | very fine |
| | | 30 | 1.00 | very fine |
| | | 50 | 1.67 | very fine |
| EXP. 19 | 50 | 10 | 0.20 | dispersed mist |
| | | 15 | 0.30 | dispersed mist |
| | | 20 | 0.40 | fine |
| | | 30 | 0.60 | very fine |
| | | 50 | 1.00 | very fine |
| | | 65 | 1.30 | very fine |

According to Table-8, when the ratio (D/H) of the height (h) of each wall 7 and the space (D) between the walls 7 adjacent to each other is equal to or greater than $\frac{1}{3}$ ($D/h \geqq \frac{1}{3}$), the fine dot image is obtained. When the ratio (D/h) is less than $\frac{1}{3}$ ($D/h < \frac{1}{3}$), the dispersion of the dots becomes large so that the quality of the dot image formed on the recording sheet is deteriorated.

In a first case where the space (D) was 20 μm (D=20 μm) and a second case where the space (D) was 8 μm (D=8 μm), the state in which the ink flew was observed by use of the stroboscope driven in synchronism with the driving pulse signal for the heater elements 9. In these cases, all heater elements 9 (64 elements) were driven at the same time. In the first case, the stabilized ink drops always flew. In the second case, when the ink drop flew, the depth of the ink on the heater element 9 became too small, and then at a next driving of the heater element 9, the ink on the heater element 9 was boiled in a moment, as shown in FIG. 48. Thus, the ink mist was dispersed from the ink jet recording head.

In the first case, the ink dot flew in accordance with processes as shown in FIG. 39 (*a*) (*b*) (*c*) and (*d*) in this sequence. That is, the ink flew from the ink jet recording head in a stabilized state.

In Experiments 18 and 19, a maximum driving frequency at which the heater element 9 could be continuously driven was experimentally determined. The result is indicated in Table-9. When the ratio (D/h) is equal to or greater than $\frac{1}{3}$ ($D/h \geqq \frac{1}{3}$), the heater element 9 can be continuously driven at a frequency equal to or greater than 2 kHz.

TABLE 9

| | HEIGHT(h) (μm) | SPACE(D) (μm) | MAX. DRIV. FREQU. (kHz) |
|---|---|---|---|
| EXP. 18 | 30 | 8 | 0.5 |
| | | 10 | 2.0 |
| | | 15 | 3.0 |
| | | 20 | 4.0 |
| | | 30 | 4.2 |
| | | 50 | 4.5 |
| EXP. 19 | 50 | 10 | 0.3 |
| | | 15 | 1.0 |
| | | 20 | 2.8 |
| | | 30 | 3.6 |
| | | 50 | 4.0 |
| | | 65 | 4.3 |

When the space (D) between the walls 7 adjacent to each other is equal to or greater than $\frac{1}{3}$, the stabilized ink drop can fly from the ink jet recording head. However, when the space (D) between the walls 7 adjacent to each other is too large, a function for preventing the pressure in the ink dispersing is decreased. Thus, the ratio (D/h) is generally determined as a value equal to or less than 20 ($D/h \leqq 20$). The ratio (D/h) is desirably equal to or less than 10 ($D/h \leqq 10$), more desirably equal to or less than 5 ($D/h \leqq 5$).

When the ratio (D/h) is equal to or greater than $\frac{1}{3}$ ($D/h \geqq \frac{1}{3}$), the walls separated from each other can be manufactured on the heater element. To obtain the walls separated from each other more certainly, it is desirable that the ratio (D/h) is equal to or greater than $\frac{1}{2}$ ($D/h \geqq \frac{1}{2}$).

Figure 40A:
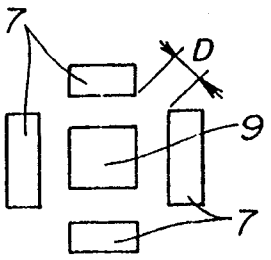
FIGS. 40*a–b* illustrate a space (D) between the walls adjacent to each other.
Figure 40B:
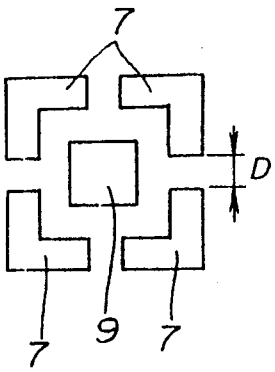
Figure 39A:
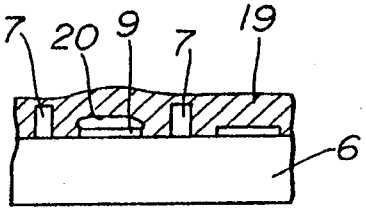
FIGS. 39*a–d* illustrate a process for generating the ink drop.
Figure 39B:
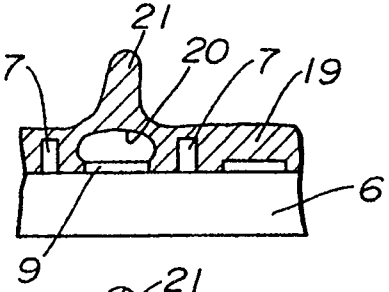
Figure 39C:
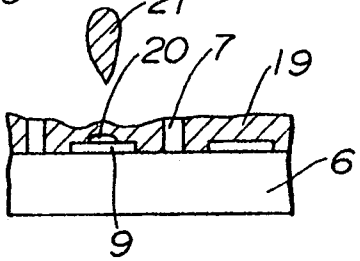
Figure 39D:
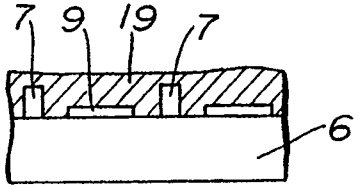

It is also possible to form the walls 7 surrounding the heater element 9 as shown in FIG. 40 (*a*) and (*b*). Also, in each of these cases, the ratio (D/h) is equal to or greater than $\frac{1}{3}$.

A description will be now given of other structures of the walls 7 surrounding the heater element 9 in reference with FIGS. 41 through 46.

Figure 42:
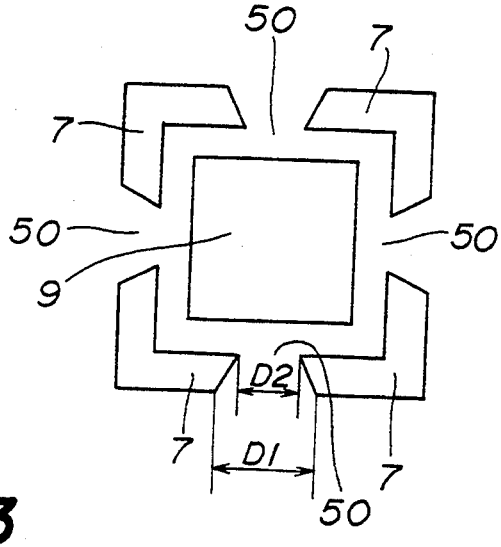
Figure 43:
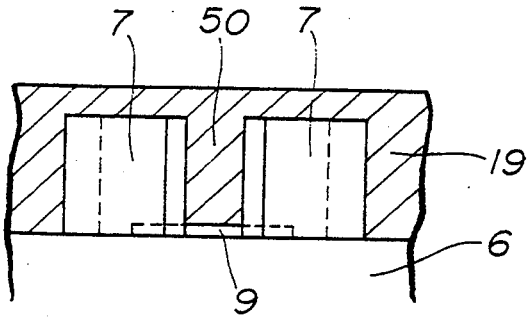

Referring to FIGS. 42 and 43, the heater element 9 are surrounded by four walls 7. Each of the walls 7 is substantially L-shaped, and opposites to a corner of the heater element 9. A space is formed between the walls 7 adjacent to each other. The space is referred to as an ink path 50. The ink 19 existing outside the walls 7 is supplied via the ink path 50 to the heater element 9. The ink path 50 becomes narrow as the distance between a position in the ink path 50 and the heater element 9 decreases. That is, a width ($D_1$) of an end of the ink path 50, which faces the heater element 9, is smaller than the width ($D_2$) of another end of the ink path 50 ($D_1 < D_2$).

According to the walls 7 surrounding the heater element 9, the ink 19 existing outside the walls 7 can be easily supplied via the ink path 50 to the heater element 9, however, it is hard for the ink on the heater element 9 to flow via the ink path 50 to the outside of the walls 7. Thus, the ink drops can be efficiently formed over the heater element 9.

Figure 41:
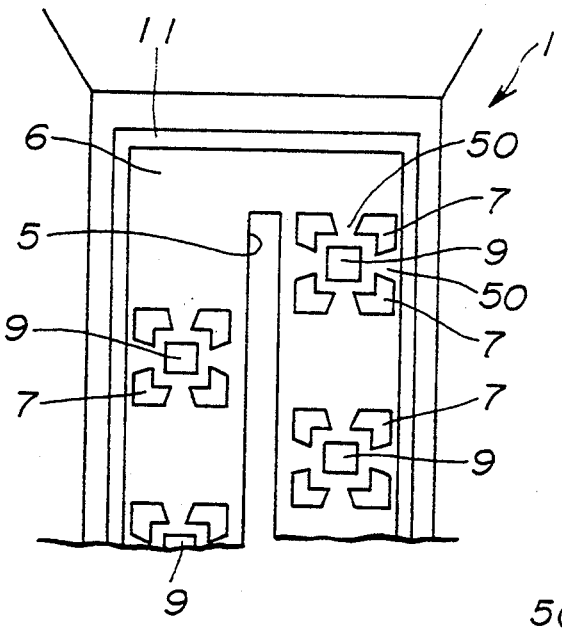
FIGS. 41, 42, 43, 44, 45 and 46 are plan views showing the structures of the walls surrounding the heater element.

In the ink jet recording head 1 shown in FIG. 41, the walls 7 surround each of the heater elements in the same manner as those shown in FIG. 42.

Figure 44:
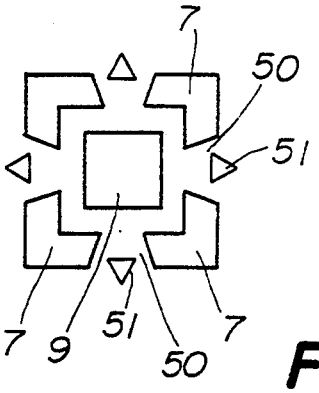

Another wall 51 can be provided at an end of the ink path 50, which faces the outside of the walls 7, as shown in FIG. 44. The wall 51 is triangular. The wall 51 is arranged so that the ink 19 existing outside the walls is easily supplied via the ink path 50 and it is hard for the ink on the heater element 9 to flow via the ink path 50 to the outside of the walls 7.

Figure 45:
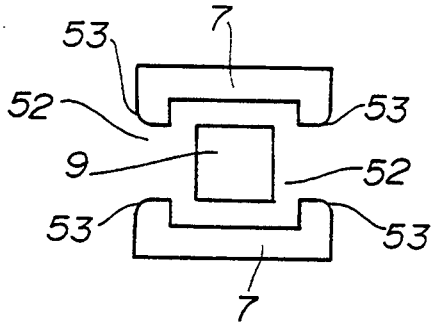
Figure 57:
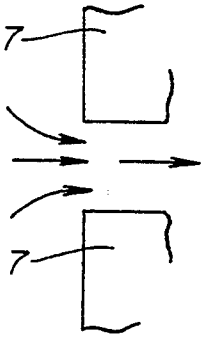
FIG. 57 is a plan view showing the flow of the ink between the walls.

The ink passes through the ink path 50, as shown in FIG. 57. In FIG. 45, two walls 7 surround the heater element 9. Ends of the walls 7 opposite to each other so that ink paths 52 are formed. Each of the ink paths 52 has a first end facing the heater element 9 and a second end facing the outside of the walls 7. Each of corners 53 of the second end of each ink path 52 is rounded. In this case, the ink outside the walls 7 can be easily supplied via the ink path 52 to the heater element 9.

Figure 46:
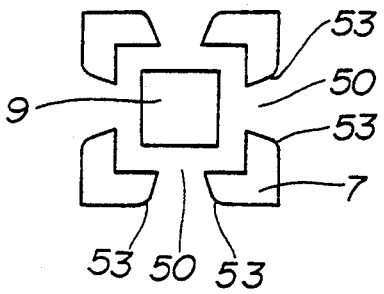

In a case where four walls surround the heater element 9 as shown in FIGS. 41 through 44, it is also possible to round the corner 53 of the end of the ink path 50, which faces the outside of the walls 7, as shown in FIG. 46.

According to the present invention, it is possible for the ink to definitely fly without using the nozzle.

The present invention is not limited to the aforementioned embodiments, and variations and modifications may be made without departing from the scope of the claimed invention.

What is claimed is:

1. A method for making a liquid drop fly from a liquid jet recording head onto a recording sheet so that a dot image is formed on said recording sheet, said liquid jet recording head having a base member, a liquid layer maintained on said base member having a continuous, non-interrupted surface, and a plurality of energy operation portions, arranged in a line on said base member, for supplying energy to liquid adjacent thereto, each of said energy operation portions being under said liquid layer and having a heater element which is heated when a driving pulse signal is supplied thereto, a cycle of said driving pulse signal being equal to or greater than (t+30) μsec. where t is a half width of an energy pulse supplied from said heater element, said method comprising the following steps (a) through (d) of:

(a) generating a bubble in the liquid layer to which the energy is supplied by said energy operation portions in accordance with image data;

(b) growing the bubble until it reaches a predetermined size, so that a liquid column projects from a surface of the liquid layer, wherein an original depth $h_1$ of the liquid layer is equal to or less than a length $h_3$ of the liquid column and a ratio $h_1/h_2$ of said original depth $h_1$ of said liquid layer and the height of the bubble $h_2$ is at least one but no greater than two when the bubble reaches said predetermined size;

(c) contracting the bubble under a condition in which none of the energy portions supply energy to the liquid in which the bubble is formed so that the liquid column projecting from the surface of the liquid layer is constricted in a root thereof when the bubble is contracted and then the liquid column is separated from the liquid layer, a liquid drop formed by the separating of the liquid Column from the liquid layer flying from the liquid layer; and (d) making the bubble disappear into the liquid, so that said liquid layer returns to an original state.

2. A method as claimed in claim 1, wherein said each of energy operation portions supplies energy to the liquid under condition where a depth of the liquid is equal to or greater than a predetermined value while steps (a) through (d) are repeatedly performed.

3. A liquid jet recording head for making a liquid drop fly onto a recording sheet so that a dot image is formed on said recording sheet, said liquid jet recording head comprising:

a base member;

a liquid layer maintained on said base member having a continuous, non-interrupted surface;

a plurality of energy operation portions, arranged in a line on said base member, for supplying energy to liquid adjacent thereto, said energy operation portions being put under said liquid layer, and generating a bubble in the liquid when each of said energy operation portions supplies the energy to the liquid adjacent thereto;

a plurality of walls, provided on said base member so as to surround the bubble, for preventing a pressure in the liquid generated by the bubble from dispersing in a direction parallel to the surface of the liquid layer, wherein a ratio $h_1/h_2$ of an original depth $h_1$ of said liquid layer and a height $h_2$ of said bubble having the largest size is at least one but no greater than two and the original depth $h_1$ of said liquid layer is equal to or less than a length $h_3$ of a column projecting from a surface of said liquid layer due to a growth of said bubble.

4. A liquid jet recording head as claimed in claim 3, wherein each of said energy operation portion has a heater element which is heated when a driving pulse signal is supplied thereto.

5. A liquid jet recording head as claimed in claim 4, wherein said walls surround the heater element.

6. A liquid jet recording head as claimed in claim 5, wherein distances between said heater element and said walls are substantially equal to each other.

7. A liquid jet recording head as claimed in claim 5, wherein said walls has a first wall and one or a plurality of other walls, a surface of said first wall which faces said heater element being wider than a surface of each of said other walls which faces said heater element, and wherein a distance between said first wall and said heater element is greater than a distance between each of said other walls and said heater element.

8. A liquid jet recording head as claimed in claim 5, wherein said walls has a second wall and one or plurality of other walls, a surface of said second wall which faces said heater element being smaller than a surface of each of said other walls which faces said heater element, and wherein said a distance between said second wall and said heater element is less than a distance between each of said other walls and said heater element.

9. A liquid jet recording head as claimed in claim 5, wherein a first side edge of said heater element which extends in a direction of a line in which heater elements are arranged is shorter than a second side edge of said heater element which extends in a direction perpendicular to the line in which the heater elements are arranged.

10. A liquid jet recording head as claimed in claim 9, wherein a surface of a wall which faces said first side edge of said heater element is smaller than a surface of a wall which faces said second side edge of said heater element.

11. A liquid jet recording head as claimed in claim 3, wherein a ratio (d/h) of a thickness (d) of each of said walls and a height (h) thereof is equal to or greater than $\frac{1}{3}$.

12. A liquid jet recording head as claimed in 3, wherein a ratio (D/h) of a space (D) between the walls adjacent to each other and the height (h) of each of said walls is equal to or greater than $\frac{1}{3}$.

* * * * *

UNITED STATES PATENT AND TRADEMARK OFFICE

CERTIFICATE OF CORRECTION

PATENT NO. : 5,412,413

DATED : May 2, 1995

INVENTOR(S) : Takuro SEKIYA, Takashi KIMURA, Masanori HORIKE, Yoshio WATANABE, Shuji MOTOMURA, Eiko SUZUKI, Takayuki YAMAGUCHI, Masami KADONAGA It is certified that error appears in the above-indentified patent and that said Letters Patent is hereby corrected as shown below:

Title page, left-hand column, section 73, change "Ricoh, Co., Ltd." to —Ricoh Company, Ltd.—.

Signed and Sealed this

Fifteenth Day of April, 1997

Bruce Lehman

*Attest:*

BRUCE LEHMAN

*Attesting Officer*

*Commissioner of Patents and Trademarks*